US008466909B2

(12) United States Patent
An et al.

(10) Patent No.: US 8,466,909 B2
(45) Date of Patent: Jun. 18, 2013

(54) OUTPUT BUFFER HAVING HIGH SLEW RATE, METHOD OF CONTROLLING OUTPUT BUFFER, AND DISPLAY DRIVING DEVICE INCLUDING OUTPUT BUFFER

(75) Inventors: Chang-ho An, Hwaseong-si (KR); Jae-wook Kwon, Yongin-si (KR); Ki-won Seo, Seoul (KR); Sung-ho Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 337 days.

(21) Appl. No.: 12/941,459

(22) Filed: Nov. 8, 2010

(65) Prior Publication Data

US 2011/0148893 A1 Jun. 23, 2011

(30) Foreign Application Priority Data

Dec. 23, 2009 (KR) ..... 10-2009-0130026

(51) Int. Cl.
*G06F 3/038* (2006.01)
*G09G 5/00* (2006.01)
*G09G 3/36* (2006.01)

(52) U.S. Cl.
USPC ..... 345/211; 345/98

(58) Field of Classification Search
None
See application file for complete search history.

(56) References Cited

U.S. PATENT DOCUMENTS

2006/0279356 A1* 12/2006 An ..... 330/253
2011/0050665 A1* 3/2011 Tsai et al. ..... 345/211
2011/0050677 A1* 3/2011 Tsai et al. ..... 345/213

FOREIGN PATENT DOCUMENTS

JP 2007-208316 A 8/2007
KR 10-0699829 B1 3/2007
KR 10-0832894 B1 5/2008

* cited by examiner

*Primary Examiner* — Xiao M. Wu
*Assistant Examiner* — Mohammad H Akhavannik
(74) *Attorney, Agent, or Firm* — Sughrue Mion, PLLC

(57) ABSTRACT

An output buffer having a high slew rate, a method of controlling the output buffer, and a display driving device including the output buffer. The output buffer includes: a first output buffer adapted to output a source line driving signal to a first output terminal in response to a first control signal and output a source driving signal to a second output terminal in response to a second control signal; a second output buffer adapted to output a source line driving signal to a third output terminal in response to the first control signal and output a source line driving signal to a fourth output terminal in response to the second control signal; and a feedback circuit for connecting the first through fourth output terminals to negative input terminals of the first and second output buffers in response to the first control signal and the second control signal.

20 Claims, 12 Drawing Sheets

FIG. 8A

| | $Y_1$ | $Y_2$ | $Y_3$ | $Y_4$ | . . . |
|---|---|---|---|---|---|
| row1 | + | − | + | − | . . . |
| row2 | − | + | − | + | . . . |
| row3 | + | − | + | − | . . . |
| row4 | − | + | − | + | . . . |
| . | . | . | . | . | |
| . | . | . | . | . | |
| . | . | . | . | . | |

FIG. 8B

| | $Y_1$ | $Y_2$ | $Y_3$ | $Y_4$ | . . . |
|---|---|---|---|---|---|
| row1 | + | + | + | + | . . . |
| row2 | − | − | − | − | . . . |
| row3 | + | + | + | + | . . . |
| row4 | − | − | − | − | . . . |
| . | . | . | . | . | |
| . | . | . | . | . | |
| . | . | . | . | . | |

FIG. 8C

| | $Y_1$ | $Y_2$ | $Y_3$ | $Y_4$ | . . . |
|---|---|---|---|---|---|
| row1 | + | − | + | − | . . . |
| row2 | + | − | + | − | . . . |
| row3 | + | − | + | − | . . . |
| row4 | + | − | + | − | . . . |
| . | . | . | . | . | |
| . | . | . | . | . | |
| . | . | . | . | . | |

FIG. 9A

| | FIRST OUTPUT BUFFER | SECOND OUTPUT BUFFER |
|---|---|---|
| Vouth | + | · |
| Voutl | + | · |

FIG. 9B

| | FIRST OUTPUT BUFFER | SECOND OUTPUT BUFFER |
|---|---|---|
| Vouth | · | − |
| Voutl | · | − |

FIG. 9C

| | FIRST OUTPUT BUFFER | SECOND OUTPUT BUFFER |
|---|---|---|
| Vouth | + | · |
| Voutl | · | − |

FIG. 9D

| | FIRST OUTPUT BUFFER | SECOND OUTPUT BUFFER |
|---|---|---|
| Vouth | · | − |
| Voutl | + | · |

OUTPUT BUFFER HAVING HIGH SLEW RATE, METHOD OF CONTROLLING OUTPUT BUFFER, AND DISPLAY DRIVING DEVICE INCLUDING OUTPUT BUFFER

CROSS-REFERENCE TO RELATED APPLICATIONS

This application claims priority from Korean Patent Application No. 10-2009-0130026, filed on Dec. 23, 2009, in the Korean Intellectual Property Office, the disclosure of which is incorporated herein in its entirety by reference.

BACKGROUND

The inventive concept relates to a display driving device having a high slew rate, and more particularly, to an output buffer having a high slew rate, a method of controlling the output buffer, and a display driving device including the output buffer.

In general, since load capacitance increases and horizontal period decreases as a display driver integrated circuit (DDI) for driving a panel of a display device, which is called a display driving device, becomes large, a high slew rate is important. Since a source integrated circuit (IC) has recently been mounted on a DDI to drive not only one liquid crystal display element but two or more liquid crystal display elements, a fast slewing time is important. Since not only a fast slewing time but also lower power consumption are required, there is a demand for a display driving device having a high slew rate, a fast slewing time or a fast settling time, and low current consumption.

SUMMARY

The inventive concept provides an output buffer that may obtain a high slew rate without increasing current consumption, a method of controlling the output buffer, and a display driving device including the output buffer.

According to an aspect of the inventive concept, there is provided an output buffer, which is included in a source driver of a display driving device and outputs a source line driving signal for driving a source line, the output buffer including: a first output buffer driven between a first voltage rail and a second voltage rail, and adapted to output a first source line driving signal to a first output terminal in response to a first control signal and output a second source driving signal to a second output terminal in response to a second control signal; a second output buffer driven between a third voltage rail and a fourth voltage rail, and adapted to output a third source line driving signal to a third output terminal in response to the first control signal and output a fourth source line driving signal to a fourth output terminal in response to the second control signal; and a feedback circuit for connecting the first through fourth output terminals to negative input terminals of the first and second output buffers in response to the first control signal and the second control signal, wherein the first output terminal of the first output buffer is connected to the third output terminal of the second output buffer, and the second output terminal of the first output buffer is connected to the fourth output terminal of the second output buffer.

The feedback circuit may include: a first feedback circuit for connecting the first output terminal of the first output buffer to the negative input terminal of the first output buffer in response to the first control signal; a third feedback circuit for connecting the third output terminal of the second output buffer to the negative input terminal of the second output buffer in response to the first control signal; a second feedback circuit for connecting the second output terminal of the first output buffer to the negative input terminal of the first output buffer in response to the second control signal; and a fourth feedback circuit for connecting the fourth output terminal of the second output buffer to the negative input terminal of the second output buffer in response to the second control signal.

A voltage of the second voltage rail may be equal to or greater than a half of a potential difference between the first voltage rail and the fourth voltage rail.

A voltage of the third voltage rail may be equal to or less than a half of a potential difference between the first voltage rail and the fourth voltage rail.

The first output buffer may include: a first input circuit for generating first differential currents and second differential currents in response to a voltage difference between first differential input signals; a first output buffer output circuit including a first output circuit including a first transistor connected between the first voltage rail and the first output terminal and a second transistor connected between the first output terminal and the second voltage rail, and a second output circuit including a third transistor connected between the first voltage rail and the second output terminal and a fourth transistor connected between the second output terminal and the second voltage rail; a first current summing circuit including a first control node for outputting a first control voltage for controlling a current flowing through at least one of the first transistor and the third transistor in response to the first differential currents, and a second control node for outputting a second control voltage for controlling a current flowing through at least one of the second transistor and the fourth transistor in response to the second differential currents; and a first output buffer switch circuit including a first switch circuit for connecting a gate of the first transistor to any one of the first control node and the first voltage rail and connecting a gate of the second transistor to any one of the second control node and the second voltage rail in response to the first control signal, and a second switch circuit for connecting a gate of the third transistor to any one of the first control node and the first voltage rail and connecting a gate of the fourth transistor to any one of the second control node and the second voltage rail in response to the second control signal.

The current summing circuit may include: a first cascode current mirror connected between the first voltage rail and the first control node; and a second cascode current mirror connected between the second voltage rail and the second control node.

The output buffer may further include: a first compensation capacitor connected between an output node of the first output buffer and a first node of the first cascode current mirror to which any one of the first differential currents is supplied; and a second compensation capacitor connected between the output node of the first output buffer and a second node of the second cascode current mirror to which any one of the second differential currents is supplied.

The output buffer may further include a short-circuit preventing unit including: a first short-circuit preventing switch connected between the output node of the first output buffer and the first output terminal of the first output circuit, and adapted to connect or disconnect the output node and the first output terminal in response to the first control signal; and a second short-circuit preventing switch connected between the output node of the first output buffer and the second output terminal of the second output circuit, and adapted to connect or disconnect the output node and the second output terminal in response to the second control signal.

The first switch circuit may connect the gate of the first transistor to the first control node, connect the gate of the second transistor to the second control node in response to the first control signal, and connect the gate of the first transistor to the first voltage rail and connect the gate of the second transistor to the second voltage rail in response to the first control signal, and the second switch circuit may connect the gate of the third transistor to the first control node, connect the gate of the fourth transistor to the second control node in response to the second control signal, and connect the gate of the third transistor to the first voltage rail and connect the gate of the fourth transistor to the second voltage rail in response to the second control signal.

The first switch circuit may include: a first switch for controlling connection between the first control node and the gate of the first transistor in response to the first control signal; a second switch for controlling connection between the second control node and the gate of the second transistor in response to the first control signal; a third switch for controlling connection between the first voltage rail and the gate of the first transistor in response to the first control signal; and a fourth switch for controlling connection between the second voltage rail and the gate of the second transistor in response to the first control signal, and the second switch circuit may include: a fifth switch for controlling connection between the first control node and the gate of the third transistor in response to the second control signal; a sixth switch for controlling connection between the second control node and the gate of the fourth transistor in response to the second control signal; a seventh switch for controlling connection between the first voltage rail and the gate of the third transistor in response to the second control signal; and an eighth switch for controlling connection between the second voltage rail and the gate of the fourth transistor in response to the second control signal.

Each of the first switch, the second switch, the fifth switch, and the sixth switch may include a transmission gate.

Each of the third switch and the seventh switch may include a p-channel metal oxide semiconductor field effect transistor (PMOSFET), and each of the fourth switch and the eighth switch may include an n-channel metal oxide semiconductor field effect transistor (NMOSFET).

The output buffer may further include a bias circuit connected between the first control node and the second control node, and adapted to determine a static current of each of the first transistor, the second transistor, the third transistor, and the fourth transistor.

The second output buffer may include: a second input circuit for generating third differential currents and fourth differential currents in response to a voltage difference between second differential input signals; a second output buffer output circuit including a third output circuit including a fifth transistor connected between the third voltage rail and the third output terminal and a sixth transistor connected between the third output terminal and the fourth voltage rail, and a fourth output circuit including a seventh transistor connected between the third voltage rail and the fourth output terminal and an eighth transistor connected between the fourth output terminal and the fourth voltage rail; a second current summing circuit including a third control node for outputting a third control voltage for controlling a current flowing through at least one of the fifth transistor and the seventh transistor in response to the third differential currents, and a fourth control node for outputting a fourth control voltage for controlling a current flowing through at least one of the sixth transistor and the eighth transistor in response to the fourth differential currents; and a second output buffer switch circuit including a third switch circuit for connecting a gate of the fifth transistor to any one of the third control node and the third voltage rail and connecting a gate of the sixth transistor to any one of the fourth control node and the fourth voltage rail in response to the first control signal, and a fourth switch circuit for connecting a gate of the seventh transistor to any one of the third control node and the third voltage rail and connecting a gate of the eighth transistor to any one of the fourth control node and the fourth voltage rail in response to the second control signal.

The current summing circuit may include: a third cascode current mirror connected between the third voltage rail and the third control node; and a fourth cascode current mirror connected between the fourth voltage rail and the fourth control node.

The output buffer may further include: a third compensation capacitor connected between an output node of the second output buffer and a first node of the third cascode current mirror to which any one of the third differential currents is supplied; and a fourth compensation capacitor connected between an output node of the second output buffer and a second node of the fourth cascode current mirror to which any one of the fourth differential currents is supplied.

The output buffer may further include: a third short-circuit preventing switch connected between an output node of the second output buffer and the third output terminal of the third output circuit, and adapted to connect or disconnect the output node and the third output terminal in response to the first control signal; and a fourth short-circuit preventing switch connected between the output node of the second output buffer and the fourth output terminal, and adapted to connect or disconnect the output node and the fourth output terminal in response to the second control signal.

The third switch may connect the gate of the fifth transistor to the third control node, connect the gate of the sixth transistor to the fourth control node in response to the first control signal, and connect the gate of the fifth transistor to the third voltage rail and connect the gate of the sixth transistor to the fourth voltage rail in response to the first control signal, and the fourth switch circuit may connect the gate of the seventh transistor to the third control node, connect the gate of the eighth transistor to the fourth control node in response to the second control signal, and connect the gate of the seventh transistor to the third voltage rail and connect the gate of the eighth transistor to the fourth voltage rail in response to the second control signal.

The third switch circuit may include: a ninth switch for controlling connection between the third control node and the gate of the fifth transistor in response to the first control signal; a tenth switch for controlling connection between the fourth control node and the gate of the sixth transistor in response to the first control signal; a eleventh switch for controlling connection between the third voltage rail and the gate of the fifth transistor in response to the first control signal; and a twelfth switch for controlling connection between the fourth voltage rail and the gate of the sixth transistor in response to the first control signal, and the fourth switch circuit may include: a thirteenth switch for controlling connection between the third control node and the gate of the seventh transistor in response to the second control signal; a fourteenth switch for controlling connection between the fourth control node and the gate of the eighth transistor in response to the second control signal; a fifteenth switch for controlling connection between the third voltage rail and the gate of the seventh transistor in response to the second control signal; and a sixteenth switch for controlling connection between the fourth voltage rail and the gate of the eighth transistor in response to the second control signal.

Each of the ninth switch, the tenth switch, the thirteenth switch, and the fourteenth switch may include a transmission gate.

Each of the thirteenth switch and the seventeenth switch may include a PMOSFET, and each of the fourteenth switch and the eighteenth switch may include an NMOSFET.

The output buffer may further include a bias circuit that is connected between the third control node and the fourth control node and determines a static current of each of the fifth transistor, the sixth transistor, the seventh transistor, and the eighth transistor.

According to another aspect of the inventive concept, there is provided a method of controlling an output buffer that is included in a source driver of a display driving device and outputs a source line driving signal for driving a source line, the method including: driving a first output buffer between a first voltage rail and a second voltage rail, outputting a source line driving signal to a first output terminal in response to a first control signal and outputting a source line driving signal to a second output terminal in response to a second control signal; driving a second output buffer between a third voltage rail and a fourth voltage rail, outputting a source line driving signal to a third output terminal in response to the first control signal and outputting a source line driving signal to a fourth output terminal in response to the second control signal; and connecting the first through fourth output terminals to negative input terminals in response to the first control signal and the second control signal, wherein the first output terminal is connected to the third output terminal, and the second output terminal is connected to the fourth output terminal.

The operations set forth above may be performed via a computer readable recording medium having thereon a computer program for executing the operations.

According to another aspect of the inventive concept, there is provided a display driving device including: a plurality of unit gain output buffers; and a plurality of charge sharing switches for controlling connections of the plurality of unit gain output buffers respectively connected to source lines in response to charge sharing control signals, wherein each of the plurality of unit gain output buffers includes: a first output buffer driven between a first voltage rail and a second voltage rail, and adapted to output a source line driving signal to a first output terminal in response to a first control signal and output a source line driving signal to a second output terminal in response to a second control signal; a second output buffer driven between a third voltage rail and a fourth voltage rail, and adapted to output a source line driving signal to a third output terminal in response to the first control signal and output a source line driving signal to a fourth output terminal in response to the second control signal; and a feedback circuit for connecting the first through fourth output terminals to negative input terminals of the first and second output buffers in response to the first control signal and the second control signal, wherein the first output terminal of the first output buffer is connected to the third output terminal of the second output buffer, and the second output terminal of the first output buffer is connected to the fourth output terminal of the second output buffer.

In a charge sharing mode, the source lines may be respectively connected to the plurality of unit gain output buffers, so that the source lines are precharged to a precharge voltage, and in an amplification mode, the source lines may not be connected to the plurality of unit gain output buffers, so that the plurality of unit gain output buffers output source line driving signals in response to the first control signal and the second control signal.

Each of the first control signal and the second control signal may correspond to a signal obtained by delaying a sharing switch control signal for controlling the source lines to be precharged to the precharge voltage.

Each of the first control signal and the second control signal may correspond to a signal obtained by delaying the sharing switch control signal through D flip-flops by a charge sharing time that is a time taken for the source lines to be precharged to the precharge voltage.

According to another aspect of the inventive concept, there is provided a display driving device comprising: at least one output buffer, wherein the at least one output buffer comprises a first output buffer having at least a first output terminal, a second output terminal, and a first negative input and a second output buffer having at least a third output terminal, a fourth output terminal, and a second negative input, wherein the first output terminal is connected to both the third output terminal of the second output buffer and the first negative input of the first output buffer and wherein the second output terminal is connected to both the fourth output terminal of the second output buffer and the first negative input of the first output buffer, and wherein the third output terminal is connected to both the first output terminal of the first output buffer and the second negative input of the second output buffer and the fourth output terminal is connected to both the second output terminal of the first output buffer and the second negative input of the second output buffer.

Accordingly, a high slew rate may be obtained without increasing current consumption. In particular, a high slew rate may be obtained and the size of a chip may be reduced without increasing current consumption.

Furthermore, since heat is prevented from being generated in an output transmission gate, heat generation may be reduced.

BRIEF DESCRIPTION OF THE DRAWINGS

Exemplary embodiments of the inventive concept will be more clearly understood from the following detailed description taken in conjunction with the accompanying drawings in which:

FIG. 8A illustrates a case where a source driver uses dot inversion in one frame;

FIG. 8B illustrates a case where a source driver uses line inversion in one frame;

FIG. 8C illustrates a case where a source driver uses column inversion in one frame;

FIGS. 9A, 9B, 9C, and 9D illustrate output voltages of the split rail-to-rail output buffer of FIG. 4 in a first mode, a second mode, a third mode, and a fourth mode, respectively;

DETAILED DESCRIPTION OF EXEMPLARY EMBODIMENTS

Figure 1:
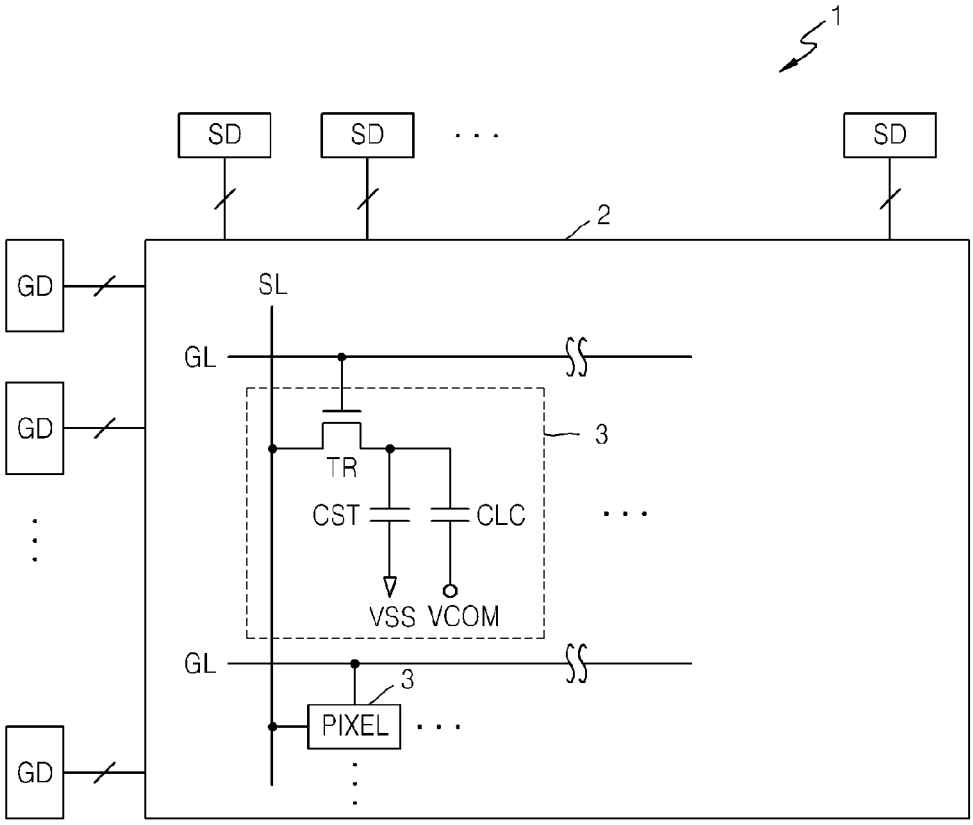
FIG. 1 is a circuit diagram of a liquid crystal display (LCD) device.

In order to fully understand operational advantages of the inventive concept and objects to be attained by exemplary embodiments of the inventive concept, the accompanying drawings illustrating exemplary embodiments of the inventive concept and details described in the accompanying drawings should be referred to.

The inventive concept will now be described more fully with reference to the accompanying drawings, in which exemplary embodiments of the inventive concept are shown. Like reference numerals denote like elements in the drawings.

FIG. 1 is a circuit diagram of a liquid crystal display (LCD) device 1.

LCD devices have the advantages of being designed to be small and thin and are low power consumption devices that are used in notebook computers, LCD TVs, and so on. In particular, active matrix LCD devices using a thin-film transistor (TFT) as a switch element are suitable for displaying moving images.

Referring to FIG. 1, the LCD device 1 includes a liquid crystal panel 2, source drivers SDs respectively including a plurality of source lines SLs, and gate drivers GDs respectively including a plurality of gate lines GLs. The source lines SLs may be referred to as data lines or channels.

The source drivers SDs drive the source lines SLs disposed on the liquid crystal panel 2. The gate drivers GDs drive the gate lines GLs disposed on the liquid crystal panel 2.

The liquid crystal panel 2 includes a plurality of pixels 3. Each of the pixels 3 includes a switch transistor TR, a storage capacitor CST for reducing current leakage from a liquid crystal, and a liquid crystal capacitor CLC. The switch transistor TR is turned on/off in response to a signal for driving each of the gate lines GLs. One terminal of the switch transistor TR is connected to a source line SL. The storage capacitor CST is connected between another terminal of the switch transistor TR and a ground voltage source VSS, and the liquid crystal capacitor CLC is connected between the other terminal of the switch transistor TR and a common voltage source VCOM. For example, a common voltage output from the common voltage source VCOM may be a half of a power voltage output from the power voltage source VDD (not shown).

Loads of the source lines SLs respectively connected to the pixels 3 disposed on the liquid crystal panel 2 may be modelled with parasitic resistors and parasitic capacitors.

Figure 2:
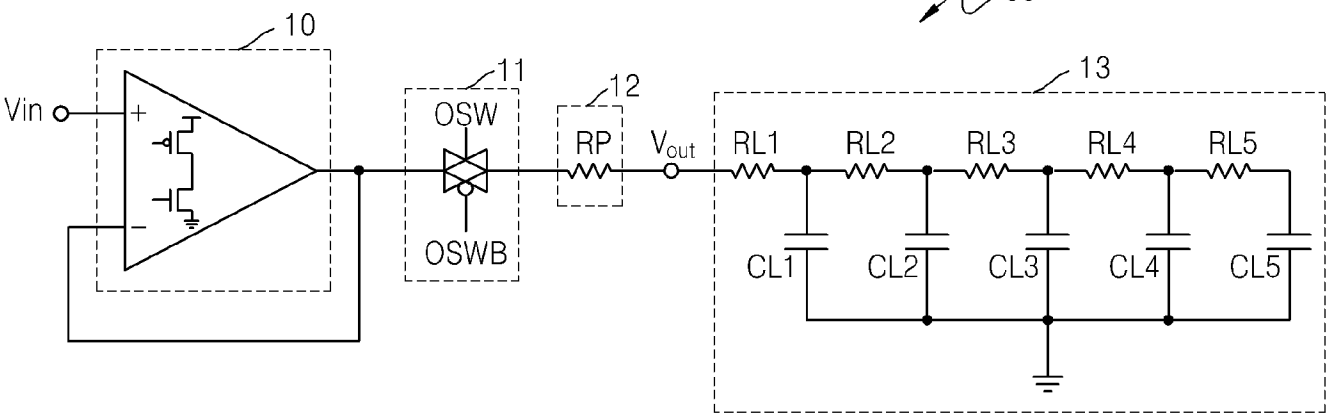
FIG. 2 is a circuit diagram illustrating a source driver used in the LCD device of FIG. 1, according to an exemplary embodiment of the inventive concept.

FIG. 2 is a circuit diagram illustrating a source driver 50 used in the LCD device 1 of FIG. 1, according to an exemplary embodiment of the inventive concept.

Referring to FIG. 2, the source driver 50 includes an output buffer 10, an output switch 11, an output protection resistor 12, and a load 13 connected to a source line.

The output buffer 10 amplifies an analog image signal to obtain an amplified analog image signal and transmits the amplified analog image signal to the output switch 11. The output switch 11 outputs the amplified analog image signal in response to an output switch control signal OSW or OSWB as a source line driving signal. The source line driving signal is applied to the load 13 connected to the source line. As shown in FIG. 2, the load 13 may be modelled with parasitic resistors RL1 through RL5 and parasitic capacitors CL1 through CL5 which are connected in a ladder configuration.

An output voltage Vout of the output buffer 10 is given by Equation 1.

$$Vout = Vin(1 - e^{-t/RC}) \quad \text{[Equation 1]}$$

where Vin is a voltage input to a positive terminal of the output buffer 10, R is a sum of resistances of the output switch 11, the output protection resistor 12, and the load 13 connected to the source line, and C is a sum of capacitances of the parasitic capacitors CL1 through CL5 of the load 13 connected to the source line.

A slew rate SR is given by Equation 2.

$$SR = \frac{dVout}{dt} = \frac{V_{IN}}{\tau}(e^{-t/\tau}),\ \tau = RC \quad \text{[Equation 2]}$$

It is found from Equation 2 that as a time constant $\tau$ decreases, the slew rate SR increases.

The inventive concept removes a resistance component of the output switch 11 in order to obtain a high slew rate SR by reducing a time constant $\tau$.

Figure 3:
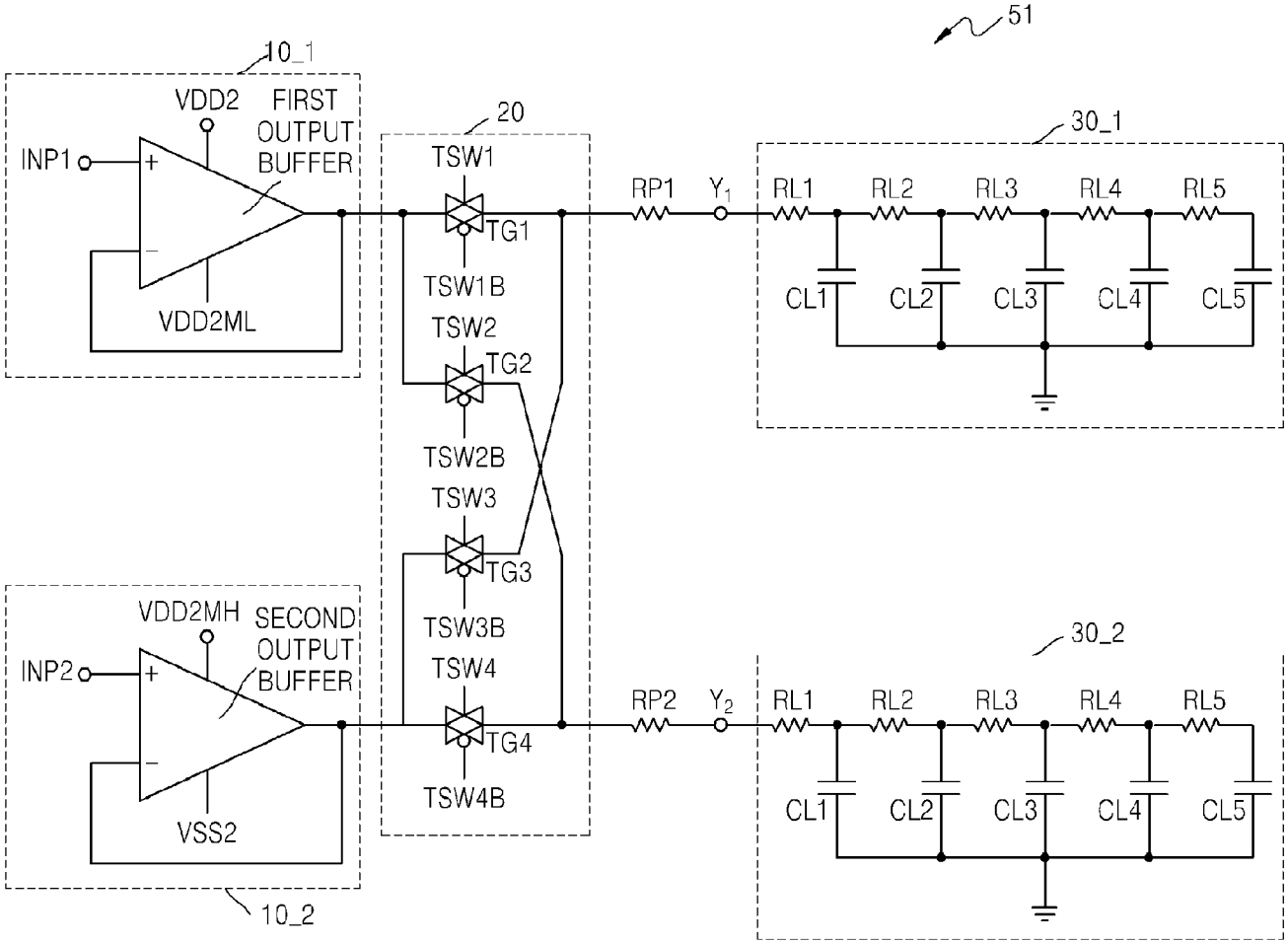
PRIOR ART FIG. 3
FIG. 3 is a circuit diagram illustrating a source driver including a conventional split rail-to-rail output buffer.

FIG. 3 is a circuit diagram of a source driver 51 including a conventional split rail-to-rail output buffer.

Referring to FIG. 3, the conventional split rail-to-rail output buffer of the source driver 51 includes a first output buffer 10_1 and a second output buffer 10_2. The first output buffer 10_1 is driven between a first voltage rail VDD2 and a second voltage rail VDD2ML, and the second output buffer 10_2 is driven between a third voltage rail VDD2MH and a fourth voltage rail VSS2.

The first output buffer 10_1 amplifies a first input analog image signal INP1 to obtain an amplified first input analog image signal, and outputs the amplified first input analog image signal as a source line driving signal to an output transmission gate 20. The second output buffer 10_2 amplifies a second input analog image signal INP2 to obtain an amplified second input analog image signal, and outputs the amplified second input analog image signal as a source line driving signal to the output transmission gate 20.

The output transmission gate 20 corresponding to the output switch 11 of FIG. 2 includes a plurality of transmission switches TG1, TG2, TG3, and TG4.

The plurality of transmission switches TG1, TG2, TG3, and TG4 included in the output transmission gate 20 transmit source line driving signals, which are analog image signals amplified by the first output buffer 10_1 and the second output buffer 10_2, to source lines Y1 and Y2, in response to a plurality of transmission control signals TSW1, TSW2, TSW3, and TSW4 and compensation transmission control signals TSW1B, TSW2B, TSW3B, and TSW4B. The configurations of loads 30_1 and 30_2 connected to the source lines Y1 and Y2 and output protection resistors RP1 and RP2, respectively are the same as those stated with reference to FIG. 2, and thus a detailed explanation thereof will not be given.

For example, a voltage level of a source line driving signal output from the first output buffer 10_1 may be a high level and a voltage level of a source line driving signal output from the second output buffer 10_2 may be a low level. In this case, the output transmission gate 20 may transmit source line driving signals having high levels to both the source lines Y1 and Y2, or source line driving signals having low levels to both the source lines Y1 and Y2. Alternatively, the output transmission gate 20 may transmit a source line driving signal having a high level to the source line Y1 and a source line driving signal having a low level to the source line Y2, or may transmit a source line driving signal having a low level to the source line Y1 and a source line driving signal having a high level to the source line Y2.

Since the output transmission gate 20 includes the plurality of transmission switches TG1, TG2, TG3, and TG4, a slew rate SR is reduced due to resistances of the plurality of transmission switches TG1, TG2, TG3, and TG4, thereby lengthening a slewing time. Also, since the output transmission gate 20 is included in the source driver 51, the layout area of a display driving device including the source driver 51 is increased.

Figure 4:
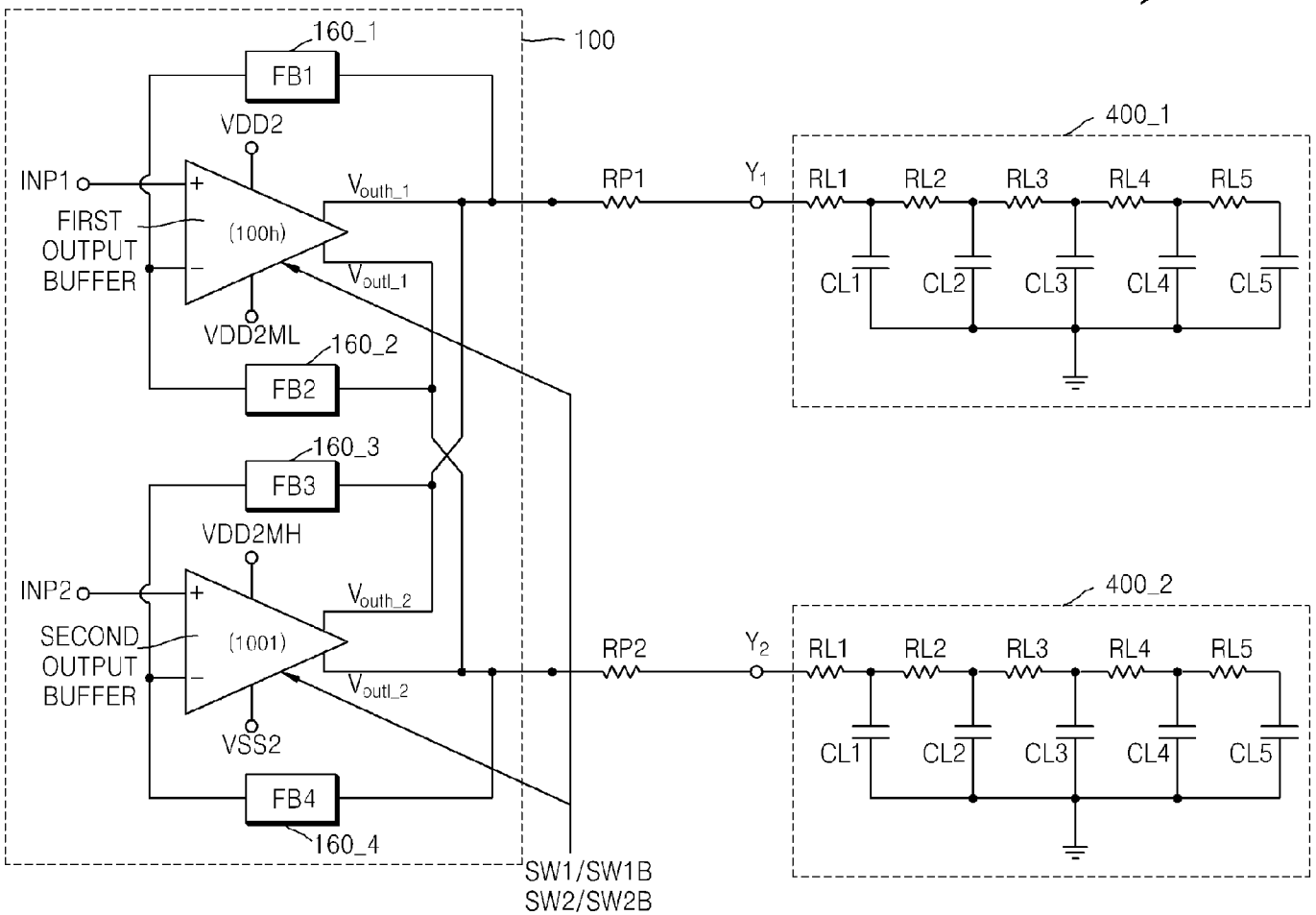
FIG. 4 is a circuit diagram illustrating a source driver including a split rail-to-rail output buffer according to an exemplary embodiment of the inventive concept.

FIG. 4 is a circuit diagram illustrating a source driver 52 including a split rail-to-rail output buffer 100 according to an exemplary embodiment of the inventive concept.

The source driver 52 of FIG. 4 does not include an output transmission gate, unlike the source driver 51 of FIG. 3. In FIG. 4, although no output transmission gate is included in the source driver 52, an output transmission gate is included in the split rail-to-rail output buffer 100, so as to obtain a high slew rate SR, reduce a slewing time, and reduce the layout area of a display driving device including the source driver 52.

The split rail-to-rail output buffer 100 includes a first output buffer **100*h*, a second output buffer 1001**, and feedback circuits.

The first output buffer **100*h*** is driven between a first voltage rail VDD2 and a second voltage rail VDD2ML, and outputs a source line driving signal to a first output terminal $V_{outh_1}$ in response to a first control signal SW1 and outputs a source line driving signal to a second output terminal $V_{outl_1}$ in response to a second control signal SW2.

The second output buffer 1001 is driven between a third voltage rail VDD2MH and a fourth voltage rail VSS2, and outputs a source line driving signal to a third output terminal $V_{outh_2}$ in response to the first control signal SW1 and outputs a source line driving signal to a fourth output terminal $V_{outl_2}$ in response to the second control signal SW2.

The feedback circuits connect the first through fourth output terminals $V_{outh_1}$, $V_{outl_1}$, $V_{outh_2}$, and $V_{outl_2}$ to negative input terminals of the first and second output buffers **100*h* and 1001** in response to the first control signal SW1 and the second control signal SW2.

The first output terminal $V_{outh_1}$ of the first output buffer **100*h* is connected to the third output terminal $V_{outh_2}$ of the second output buffer 1001, and the second output terminal $V_{outh_1}$ of the first output buffer 100*h* is connected to the fourth output terminal $V_{outl_2}$ of the second output buffer 1001**.

Since each of the first output buffer **100*h* and the second output buffer 1001 of the split rail-to-rail output buffer 100 of FIG. 4 includes two output terminals, a total of 4 feedback circuits are necessary. Accordingly, the feedback circuits include a first feedback circuit 160_1, a second feedback circuit 160_2, a third feedback circuit 160_3, and a fourth feedback circuit 160_4**.

The principle on which source line driving signals are output to and fed back from output terminals of the first output buffer **100*h* and the second output buffer 1001** in response to the first control signal SW1 and the second control signal SW2, will now be explained in detail.

In response to the first control signal SW1, for example, if the first control signal SW1 has a high level, a source line driving signal is output to the first output terminal $V_{outh_1}$ of the first output buffer **100*h*, and the first feedback circuit 160_1 connects the first output terminal $V_{outh_1}$ of the first output buffer 100*h* to the negative input terminal of the first output buffer 100*h* to form a negative feedback circuit of the first output buffer 100*h***.

In response to the first control signal SW1, for example, if the first control signal SW1 has a low level, a source line driving signal is output to the third output terminal $V_{outh_2}$ of the second output buffer 1001, and the third feedback circuit 160_3 connects the third output terminal $V_{outh_2}$ of the second output buffer 1001 to the negative input terminal of the second output buffer 1001 to form a negative feedback circuit of the second output buffer 1001.

In response to the second control signal SW2, for example, if the second control signal SW2 has a high level, a source line driving signal is output to the second output terminal $V_{outh_1}$ of the first output buffer **100*h*, and the second feedback circuit 160_2 connects the second output terminal $V_{outh_1}$ of the first output buffer 100*h* to the negative input terminal of the first output buffer 100*h* to form a negative feedback circuit of the first output buffer 100*h***.

In response to the second control signal SW2, for example, if the second control signal SW2 has a low level, a source line driving signal is output to the fourth output terminal $V_{outl_2}$ of the second output buffer 1001, and the fourth feedback circuit 160_4 connects the fourth output terminal $V_{outl_2}$ of the second output buffer 1001 to the negative input terminal of the second output buffer 1001 to form a negative feedback circuit of the second output buffer 1001.

The first feedback circuit 160_1 may be a switching element that is turned on irrespective of a signal level of the second controls signal SW2 if the first control signal SW1 has a high level, and the second feedback circuit 160_2 may be a switching element that is turned on irrespective of a signal level of the first control signal SW1 if the second control signal SW2 has a high level.

The third feedback circuit 160_3 may be a switching element that is turned on irrespective of a signal level of the second control signal SW2 if the first control signal SW1 has a low level, and the fourth feedback circuit 160_4 may be a switching element that is turned on irrespective of a signal level of the first control signal SW1 if the second control signal SW2 has a low level.

A voltage of the second voltage rail VDD2ML may be equal to or greater than a half of a potential difference between the first voltage rail VDD2 and the fourth voltage rail VSS2. A voltage of the third voltage rail VDD2MH may be equal to or less than a half of a potential difference between the first voltage rail VDD2 and the fourth voltage rail VSS2.

For example, if a voltage of the first voltage rail VDD2 is 10 V and a voltage of the fourth voltage rail VSS2 is 0 V, a voltage of the second voltage rail VDD2ML may be 5 V or slightly greater than 5 V, and a voltage of the third voltage rail VDD2MH may be 5 V or slightly less than 5 V.

Figure 5:
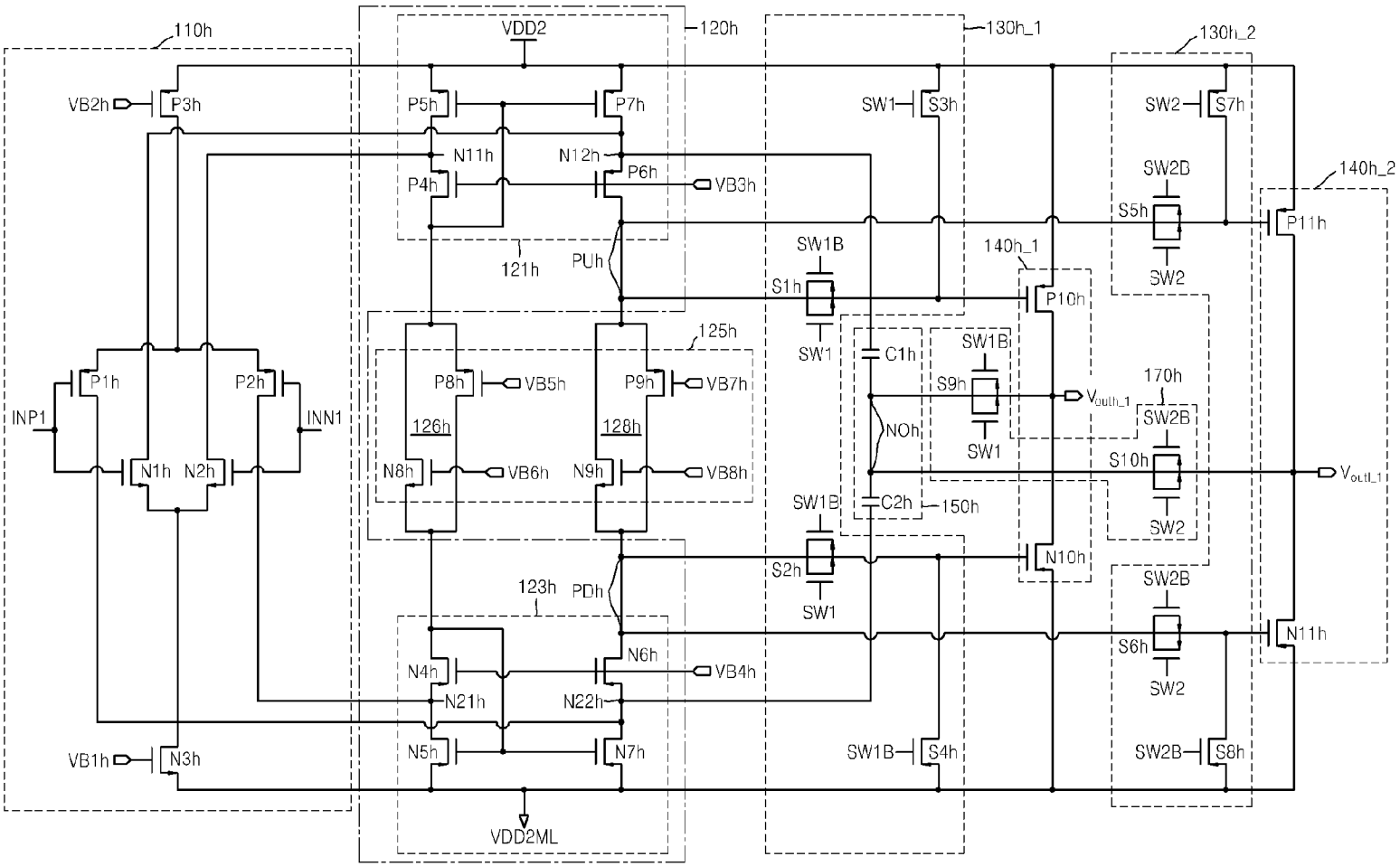
FIG. 5 is a circuit diagram illustrating a first output buffer of the split rail-to-rail output buffer of FIG. 4, according to an exemplary embodiment of the inventive concept.

FIG. 5 is a circuit diagram illustrating the first output buffer 100*h* of the split rail-to-rail output buffer 100 of FIG. 4, according to an exemplary embodiment of the inventive concept.

Referring to FIG. 5, the first output buffer 100*h* includes an input circuit 110*h*, a current summing circuit 120*h*, a bias circuit 125*h*, switch circuits, first and second output circuits 140*h*_1 and 140*h* 2, a compensation capacitor unit 150*h*, and a short-circuit preventing unit 170*h*.

The input circuit 110*h* at an input stage includes a first differential amplifier and a second differential amplifier.

The first differential amplifier includes a pair of n-channel metal oxide semiconductor field effect transistors (NMOSFETs) N1*h* and N2*h* connected to the second voltage rail VDD2ML through a third NMOSFET N3*h*. The NMOSETs N1*h* and N2*h* have a common source configuration. The third NMOSFET N3*h* functioning as a current source controls the amount of a bias current supplied to the first differential amplifier in response to a first bias control voltage VB1*h*. Drains of the NMOSFETs N1*h* and N2*h* are respectively connected to left and right nodes N11*h* and N12*h* of a first current mirror 121*h*.

The second differential amplifier includes a pair of p-channel metal oxide semiconductor field effect transistors (PMOSFETs) P1*h* and P2*h* connected to the first voltage rail VDD2 through a third PMOSFET P3*h*. The PMOSFETs P1*h* and P2*h* have a common source configuration. The third PMOSFET P3*h* functioning as a current source controls the amount of a bias current supplied to the second differential amplifier in response to a second bias control voltage VB2*h*. Drains of the PMOSFETs P1*h* and P2*h* are respectively connected to left and right nodes N21*h* and N22*h* of a second current mirror 123*h*.

The first voltage rail VDD2 applies a first voltage, and the second voltage rail VDD2ML applies a second voltage that is less than the first voltage.

The first differential amplifier generates first differential currents in response to a voltage difference between first differential input signals INP1 and INN1. The second differential amplifier generates second differential currents in response to the voltage difference between the first differential input signals INP1 and INN1.

The input circuit 110*h* is a folded cascode operational transconductance amplifier (OTA) so that the input circuit 110*h* converts a voltage difference between the first differential input signals INP1 and INN1 into differential currents for determining an output voltage $V_{outh_1}$ or $V_{outh_1}$ of an output node NOh.

The current summing circuit 120*h* includes the first current mirror 121*h* and the second current mirror 123*h*. Each of the first current mirror 121*h* and the second current mirror 123*h* may be a cascode current mirror and hereinafter the first current mirror 121*h* and the second current mirror 123*h* will be referred to as the first cascode current mirror 121*h* and the second cascode current mirror 123*h*.

The first cascode current mirror 121*h* is connected between the first voltage rail VDD2 and the bias circuit 125*h*. The first cascode current mirror 121*h* includes a plurality of PMOSFETs P4*h*, P5*h*, P6*h*, and P7*h*. The plurality of PMOSFETs P4, P5*h*, P6*h*, and P7*h* constitute a common gate amplifier. The first cascode current mirror 121*h* outputs to a first control node PUh, a first control voltage for controlling a current flowing through a first transistor P10*h* of the first output circuit 140*h*_1 and a third transistor P11*h* of the second output circuit 140*h*_2 in response to at least one of the first differential currents and a third bias control voltage VB3*h*. Each of the first transistor P10*h* and the third transistor P11*h* may be a PMOSFET.

The second cascode current mirror 123*h* is connected between the bias circuit 125*h* and the second voltage rail VDD2ML. The second cascode current mirror 123*h* includes a plurality of NMOSFETs N4*h*, N5*h*, N6*h*, and N7*h*. The plurality of NMOSFETs N4*h*, N5*h*, N6*h*, and N7*h* constitute a common gate amplifier. The second cascode current mirror 123*h* outputs to a second control node PDh, a second control voltage for controlling a current flowing through a second transistor N10*h* of the first output circuit 140*h*_1 and a fourth transistor N11*h* of the second output circuit 140*h*_2 in response to at least one of the second differential currents and a fourth bias control voltage VB4*h*. Each of the second transistor N10*h* and the fourth transistor N11*h* may be an NMOSFET.

The bias circuit 125*h* includes a first bias circuit 126*h* called a floating current source, and a second bias circuit 128*h* called a floating class AB control circuit.

The first bias circuit 126*h* connected between the first cascode current mirror 121*h* and the second cascode current mirror 123*h* is controlled in response to a fifth bias control voltage VB5*h* and a sixth bias control voltage VB6*h*.

The second bias circuit 128*h* connected between the first control node PUh and the second control node PDh controls the amount of a current, for example, a static (quiescent) current, flowing through the first output circuit 140*h*_1 and the second output circuit 140*h*_2 in response to a seventh bias control voltage VB7*h* and an eighth bias control voltage VB8*h*.

The input circuit 110*h* and the current summing circuit 120*h* control a level of a current flowing through the first output circuit 140*h*_1 and the second output circuit 140*h*_2. That is, the input circuit 110*h* generates first differential currents and second differential currents in response to a voltage difference between the first differential input signals INP1 and INN1. The first differential currents and the second differential currents are transmitted to the current summing circuit 120*h*. The current summing circuit 120*h* controls a voltage level of the first control node PUh and a voltage level of the second control node PDh by using the first cascode current mirror 121*h* and the second cascode current mirror 123*h*.

The current summing circuit 120*h* and the bias circuit 125*h* constitute a control unit of the first output buffer 100*h*. The control unit of the first output buffer 100*h* controls the amount of a current flowing through the first output circuit 140*h*_1 and the second output circuit 140*h* 2 in response to differential currents generated by the input circuit 110*h*, for example, the first differential currents or the second differential currents.

The switch circuits include a first switch circuit 130*h*_1 and a second switch circuit 130*h*_2.

The first switch circuit 130*h*_1 connects a gate of the first transistor P10*h* of the first output circuit 140*h*_1 to any one of the first control node PUh and the first voltage rail VDD2 and connects a gate of the second transistor N10*h* of the first output circuit 140*h*_1 to any one of the second control node PDh and the second voltage rail VDD2ML, in response to at least one of the first control signal SW1 and a complementary first control signal SW1B, complementary to the first control signal SW1.

The first switch circuit 130*h*_1 includes a plurality of switches, namely, first through fourth switches S1*h* through S4*h*. The first switch S1*h* controls connection between the first control node PUh and the gate of the first transistor P10*h* in response to the first control signal SW1 and the complementary first control signal SW1B. The second switch S2*h* controls connection between the second control node PDh and the gate of the second transistor N10*h* in response to the first control signal SW1 and the complementary first control signal SW1B. The third switch S3*h* controls connection between the first voltage rail VDD2 and the gate of the first transistor P10*h* in response to the first control signal SW1. The fourth switch S4*h* controls connection between the second voltage rail VDD2ML and the gate of the second transistor N10*h* in response to the complementary first control signal SW1B.

Each of the first switch S1*h* and the second switch S2*h* may include a transmission gate, the third switch S3*h* may include a PMOSFET, and the fourth switch S4*h* may include an NMOSFET. Alternatively, each of the first switch S1*h* and the second switch S2H may include an NMOSFET or a PMOSFET.

The second switch circuit 130*h*_2 connects a gate of the third transistor P11*h* of the second output circuit 140*h*_2 to any one of the first control node PUh and the first voltage rail VDD2 and connects a gate of the fourth transistor N11*h* of the second output circuit 140*h*_2 to any one of the second control node PDh and the second voltage rail VDD2ML, in response to at least one of the second control signal SW2 and a complementary second control signal SW2B, complementary to the second control signal SW2.

The second switch circuit 130*h*_2 includes a plurality of switches, namely, fifth through eighth switches S5*h* through S8*h*. The fifth switch S5*h* controls connection between the first control node PUh and the gate of the third transistor P11*h* in response to the second control signal SW2 and the complementary second control signal SW2B. The sixth switch S6*h* controls connection between the second control node PDh and the gate of the fourth transistor N11*h* in response to the second control signal SW2 and the complementary second control signal SW2B. The seventh switch S7*h* controls connection between the first voltage rail VDD2 and the gate of the third transistor P11*h* in response to the second control signal SW2. The eighth switch S8*h* controls connection between the second voltage rail VDD2ML and the gate of the fourth transistor N11*h* in response to the complementary second control signal SW2B.

Each of the fifth switch S5*h* and the sixth switch S6*h* may include a transmission gate, the seventh switch S7*h* may include a PMOSFET, and the eighth switch S8*h* may include an NMOSFET. Alternatively, each of the fifth switch S5*h* and the sixth switch S6*h* may include an NMOSFET or a PMOSFET.

The principle on which the first output buffer 100*h* is driven in response to the first control signal SW1 is as follows. For example, in response to the first control signal SW1 having a first level, for example, a high level (H), and the complementary first control signal SW1B having a second level, for example, a low level (L), the first switch S1*h* connects the gate of the first transistor P10*h* to the first control node PUh, the second switch S2*h* connects the gate of the second transistor N10*h* to the second control node PDh, the third switch S3*h* isolates the first voltage rail VDD2 from the gate of the first transistor P10*h*, and the fourth switch S4*h* isolates the second voltage rail VDD2ML from the gate of the second transistor N10*h*.

However, in response to the first control signal SW1 having a second level, for example, a low level (L), and the complementary first control signal SW1B having a first level, for example, a high level (H), the first switch S1*h* isolates the gate of the first transistor P10*h* from the first control node PUh, the second switch S2*h* isolates the gate of the second transistor N10*h* from the second control node PDh, the third switch S3*h* connects the first voltage rail VDD2 to the gate of the first transistor P10*h*, and the fourth switch S4*h* connects the second voltage rail VDD2ML to the gate of the second transistor N10*h*.

The principle on which the first output buffer 100*h* is driven in response to the second control signal SW2 is as follows. For example, in response to the second control signal SW2 having a first level, for example, a high level (H), and a complementary second control signal SW2B having a second level, for example, a low level (L), the fifth switch S5*h* connects the gate of the third transistor P11*h* to the first control node PUh, the sixth switch S6*h* connects the gate of the fourth transistor N11*h* to the second control node PDh, the seventh switch S7*h* isolates the first voltage rail VDD2 from the gate of the third transistor P11*h*, and the eighth switch S8*h* isolates the second voltage rail VDD2ML from the gate of the fourth transistor N11*h*.

However, in response to the second control signal SW2 having a second level, for example, a low level (L), and the complementary second control signal SW2B having a first level, for example, a high level (H), the fifth switch S5*h* isolates the gate of the third transistor P11*h* from the first control node PUh, the sixth switch S6*h* isolates the gate of the fourth transistor N11*h* from the second control node PDh, the seventh switch S7*h* connects the first voltage rail VDD2 to the gate of the third transistor P11*h*, and the eighth switch S8*h* connects the second voltage rail VDD2ML to the gate of the fourth transistor N11*h*.

The compensation capacitor unit 150*h* includes a first compensation capacitor C1*h* and a second compensation capacitor C2*h*.

The first compensation capacitor C1*h* is connected between the output node NOh and the right node N12*h* of the first cascode current mirror 121*h*, and the second compensation capacitor C2*h* is connected between the output node NOh and the right node N22*h* of the second cascode current mirror 123*h*. Alternatively, the first output buffer 100*h* may not include the first compensation capacitor C1*h* and the second compensation capacitor C2*h*.

The first output circuit 140*h*_1 including the first transistor P10*h* and the second transistor N10*h* which have a common source configuration is connected between the first voltage rail VDD2 and the second voltage rail VDD2ML. Likewise, the second output circuit 140*h*_2 including the third transistor P11*h* and the fourth transistor N11*h* which have a common source configuration is connected between the first voltage rail VDD2 and the second voltage rail VDD2ML.

Bias currents of the first transistor P10*h* and the third transistor P11*h* are determined by a first control voltage, that is, a voltage of the first control node PUh, applied to the gates of the first transistor P10*h* and the third transistor P11*h*, and bias currents of the second transistor N10*h* and the fourth transistor N11*h* are determined by a second control voltage, that is, a voltage of the second control node PDh, applied to the gates of the second transistor N10*h* and the fourth transistor N11*h*.

The short-circuit preventing unit 170*h* includes a first short-circuit preventing switch S9*h* and a second short-circuit preventing switch S10*h*.

The first short-circuit preventing switch S9*h* is connected between the output node NOh and the first output terminal $V_{outh_1}$ of the first output circuit 140*h*_1, and connects or disconnects the output node NOh and the first output terminal $V_{outh_1}$ in response to the first control signal SW1 and the complementary first control signal SW1B.

The second short-circuit preventing switch S10*h* is connected between the output node NOh and the second output terminal $V_{outl_1}$ of the second output circuit **140*h*_2, and connects or disconnects the output node NOh and the second output terminal $V_{outl_1}$ in response to the second control signal SW2 and the complementary second control signal SW2**B.

Referring to FIG. 4 again, the first output terminal $V_{outh_1}$ of the first output buffer **100*h* is connected to the third output terminal $V_{outh_2}$ of the second output buffer 1001, and the second output terminal $V_{outl_1}$ of the first output buffer 100*h* is connected to the fourth output terminal $V_{outl_2}$ of the second output buffer 1001**.

Accordingly, when a source line driving signal is output to the third output terminal $V_{outh_2}$ of the second output buffer 1001, in order to prevent a short-circuit between the first output terminal $V_{outh_1}$ of the first output buffer **100*h* and the third output terminal $V_{outh_2}$ of the second output buffer 1001, the first short-circuit preventing switch S9*h*** disconnects the output node NOh from the first output terminal $V_{outh_1}$.

Likewise, when a source line driving signal is output to the fourth output terminal $V_{outl_2}$ of the second output buffer 1001, in order to prevent a short-circuit between the second output terminal $V_{outl_1}$ of the first output buffer **100*h* and the fourth output terminal $V_{outl_2}$ of the second output buffer 1001, the second short-circuit preventing switch S10*h*** disconnects the output node NOh from the second output terminal $V_{outl_1}$.

Figure 6:
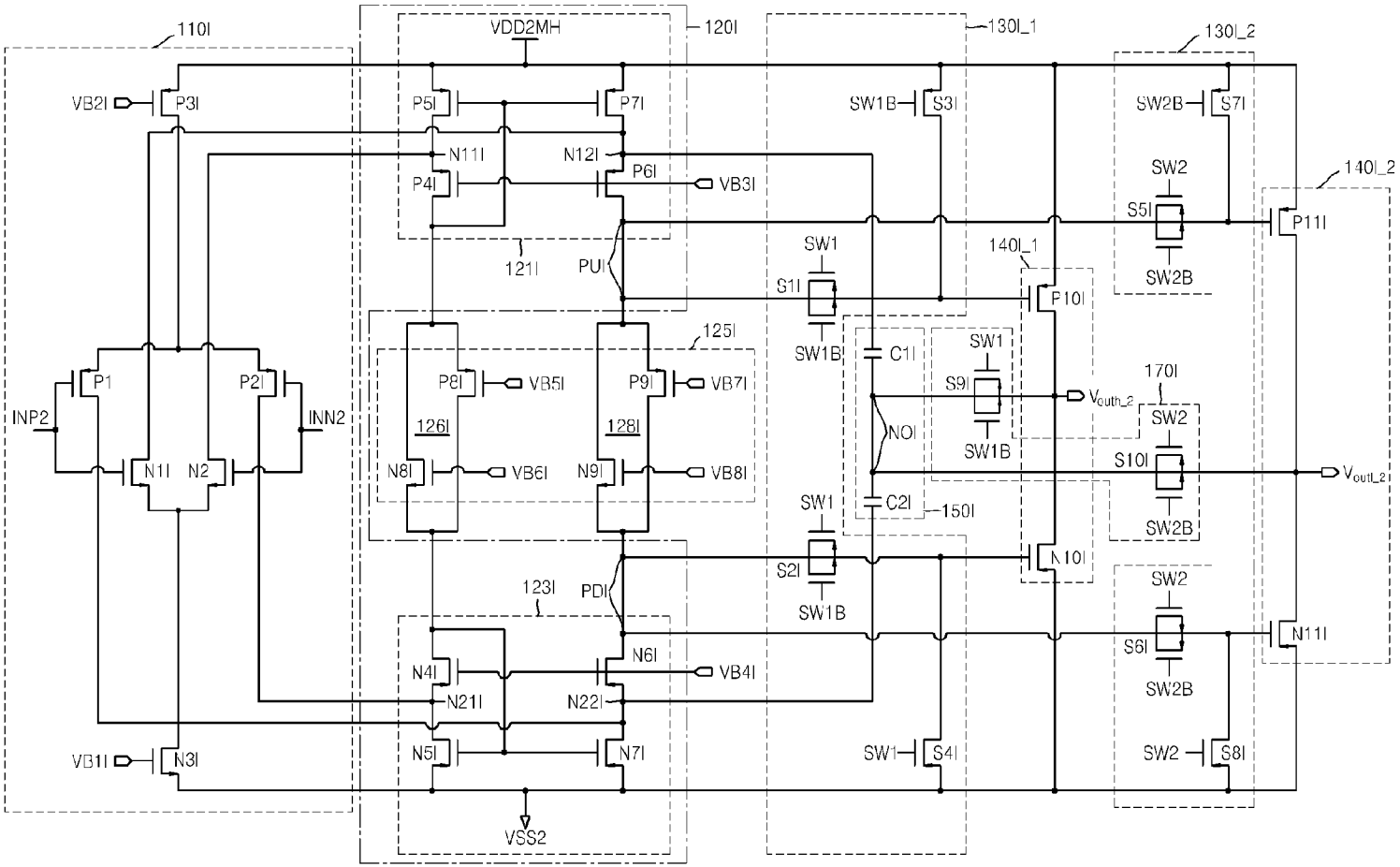
FIG. 6 is a circuit diagram illustrating a second output buffer of the split rail-to-rail output buffer of FIG. 4, according to an exemplary embodiment of the inventive concept.

FIG. 6 is a circuit diagram illustrating the second output buffer 1001 of the split rail-to-rail output buffer 100 of FIG. 4, according to an exemplary embodiment of the inventive concept.

Referring to FIG. 6, the second output buffer 1001 includes an input circuit 1101, a current summing circuit 1201, a bias circuit 1251, switch circuits, third and fourth output circuits 1401_1 and 1401_2, a compensation capacitor unit 1501, and a short-circuit preventing unit 1701.

The input circuit 1101 at an input stage includes a third differential amplifier and a fourth differential amplifier.

The third differential amplifier includes a pair of NMOSFETs N11 and N21 connected to the fourth voltage rail VSS2 through a third NMOSFET N31. The NMOSFETs N11 and N21 have a common source configuration. The third NMOSFET N31 functioning as a current source controls the amount of a bias current supplied to the third differential amplifier in response to a first bias control voltage VB11. Drains of the NMOSFETs N11 and N21 are respectively connected to left and right nodes N111 and N121 of a third current mirror 1211.

The fourth differential amplifier includes a pair of PMOSFETs P11 and P21 connected to the third voltage rail VDD2MH through a third PMOSFET P31. The PMOSFETs P11 and P21 have a common source configuration. The third PMOSFET P31 functioning as a current source that controls the amount of a bias current supplied to the fourth differential amplifier in response to a second bias control voltage VB21. Drains of the PMOSFETs P11 and P21 are respectively connected to left and right nodes N211 and N221 of a fourth current mirror 1231.

The third voltage rail VDD2MH applies a third voltage, and the fourth voltage rail VSS2 applies a fourth voltage that is less than the third voltage.

The third differential amplifier generates third differential currents in response to a voltage difference between second differential input signals INP2 and INN2. The fourth differential amplifier generates fourth differential currents in response to a voltage difference between the second differential input signals INP2 and INN2.

The input circuit 1101 is a folded cascode OTA so that the input circuit 1101 converts a voltage difference between the second differential input signals INP2 and INN2 into differential currents for determining an output voltage of the third output terminal $V_{outh_2}$ or fourth output terminal $V_{outl_2}$ of an output node N01.

The current summing circuit 1201 includes the third current mirror 1211 and the fourth current mirror 1231. Each of the third current mirror 1211 and the fourth current mirror 1231 may be a cascode current mirror, and hereinafter the third current mirror 1211 and the fourth current mirror 1231 will be referred to as the third cascade current mirror 1211 and the fourth cascade current mirror 1231.

The third cascode current mirror 1211 is connected between the third voltage rail VDD2MH and the bias circuit 1251. The third cascode current mirror 1211 includes a plurality of PMOSFETs P41, P51, P61, and P71. The plurality of PMOSFETs P41, P51, P61, and P71 constitute a common gate amplifier. The third cascode current mirror 1211 outputs to a third control node P111, a third control voltage for controlling a current flowing through a fifth transistor P101 of the third output circuit 1401_1 and a seventh transistor P111 of the fourth output circuit 1401_2 in response to at least one of the third differential currents and a third bias control voltage VB31. Each of the fifth transistor P101 and the seventh transistor P111 may be a PMOSFET.

The fourth cascode current mirror 1231 is connected between the bias circuit 1251 and the fourth voltage rail VSS2. The fourth cascode current mirror 1231 includes a plurality of NMOSFETs N41, N51, N61, and N71. The plurality of NMOSFETs N41 and N61 constitute a common gate amplifier. The fourth cascode current mirror 1231 outputs to a fourth control node PD1, a fourth control voltage for controlling a current flowing through a sixth transistor N101 of the third output circuit 1401_1 and an eighth transistor N111 of the fourth output circuit 1401_2 in response to at least one of the fourth differential currents or a fourth bias control voltage VB41. Each of the sixth transistor N101 and the eighth transistor N111 may be an NMOSFET.

The bias circuit 1251 includes a third bias circuit 1261 called a floating current source, and a fourth bias circuit 1281 called a floating class AB control circuit.

The third bias circuit 1261 connected between the third cascode current mirror 1211 and the fourth cascode current mirror 1231 is controlled in response to a fifth bias control voltage VB51 and a sixth bias control voltage VB61.

The fourth bias circuit 1281 connected between the third control node PU1 and the fourth control node PD1 controls the amount of a current, for example, a static current, flowing through the third output circuit 1401_1 and the fourth output circuit 1401_2 in response to a seventh bias control voltage VB71 and an eighth bias control voltage VB81.

The input circuit 1101 and the current summing circuit 1201 control a level of a current flowing through the third output circuit 1401_1 and the fourth output circuit 1401_2. That is, the input circuit 1101 generates third differential currents and fourth differential currents in response to a voltage difference between the second differential input signals INP2 and INN2. The third differential currents and the fourth differential currents are transmitted to the current summing circuit 1201. The current summing circuit 1201 controls a voltage level of the third control node PU1 and a voltage level of the fourth control node PD1 by using the third cascode current mirror 1211 and the fourth cascode current mirror 1231.

The current summing circuit 1201 and the bias circuit 1251 constitute a control unit of the second output buffer 1001. The control unit of the second output buffer 1001 controls the amount of a current flowing through the third output circuit 1401_1 and the fourth output circuit 1401_2 in response to differential currents generated by the input circuit 1101, for example, the third differential currents or the fourth differential currents.

The switch circuits include a third switch circuit 1301_1 and a fourth switch circuit 1301_2.

The third switch circuit 1301_1 connects a gate of the fifth transistor P101 of the third output circuit 1401_1 to any one of the third control node PU1 and the third voltage rail VDD2MH and connects a gate of the sixth transistor N10L of the third output circuit 1401_1 to any one of the fourth control node PD1 and the fourth voltage rail VSS2 in response to at least one of the first control signal SW1 and a complementary first control signal SW1B complementary to the first control signal SW1.

The third switch circuit 1301_1 includes a plurality of switches, namely, eleventh through fourteenth switches S11 through S41. The eleventh switch S11 controls connection between the third control node PU1 and the gate of the fifth transistor P101 in response to the first control signal SW1 and the complementary first control signal SW1B. The twelfth switch S21 controls connection between the fourth control node PD1 and the gate of the sixth transistor N101 in response to the first control signal SW1 and the complementary first control signal SW1B. The thirteenth switch S31 controls connection between the third voltage rail VDD2MH and the gate of the fifth transistor P101 in response to the complementary first control signal SW1B. The fourteenth switch S41 controls connection between the fourth voltage rail VSS2 and the gate of the sixth transistor N101 in response to the first control signal SW1.

Each of the eleventh switch S11 and the twelfth switch S21 may include a transmission gate, the thirteenth switch S31 may include a PMOSFET, and the fourteenth switch S41 may include an NMOSFET. Alternatively, each of the eleventh switch S11 and the twelfth switch S21 may include an NMOSFET or a PMOSFET.

The fourth switch circuit 1301_2 connects a gate of the seventh transistor P111 of the fourth output circuit 1401_2 to any one of the third control node PU1 and the third voltage rail VDD2MH and connects a gate of the eighth transistor N111 of the fourth output circuit 1401_2 to any one of the fourth control node PD1 and the fourth voltage rail VSS2 in response to at least one of the second control signal SW2 and the complementary second control signal SW2B complementary to the second control signal SW2.

The fourth switch circuit 1301_2 includes a plurality of switches, namely, fifteenth through eighteenth switches S51 through S81. The fifteenth switch S51 controls connection between the third control node PU1 and the gate of the seventh transistor P111 in response to the second control signal SW2 and the complementary second control signal SW2B. The sixteenth switch S61 controls connection between the fourth control node PD1 and the gate of the eighth transistor N111 in response to the second control signal SW2 and the complementary second control signal SW2B. The seventeenth switch S71 controls connection between the third voltage rail VDD2MH and the gate of the seventh transistor P111 in response to the complementary second control signal SW2B. The eighteenth switch S81 controls connection between the fourth voltage rail VSS2 and the gate of the eighth transistor N111 in response to the second control signal SW2.

Each of the fifteenth switch S51 and the sixteenth switch S61 may include a transmission gate, the seventeenth switch S71 may include a PMOSFET, and the eighteenth switch S81 may include an NMOSFET. Alternatively, each of the fifteenth switch S51 and the sixteenth switch S61 may include an NMOSFET or a PMOSFET.

The principle on which the second output buffer 1001 is driven in response to the first control signal SW1 is as follows. For example, in response to the first control signal SW1 having a first level, for example, a high level (H), and the complementary first control signal SW1B having a second level, for example, a low level (L), the eleventh switch S11 isolates the gate of the fifth transistor P101 from the third control node Pill, the twelfth switch S21 isolates the gate of the sixth transistor N101 from the fourth control node PD1, the thirteenth switch S31 connects the third voltage rail VDD2MH to the gate of the fifth transistor P101, and the fourteenth switch S41 connects the fourth voltage rail VSS2 to the gate of the sixth transistor N101.

However, in response to the first control signal SW1 having a second level, for example, a low level (L), and the complementary first control signal SW1B having a first level, for example, a high level (H), the eleventh switch S11 connects the gate of the fifth transistor P101 to the third control node PU1, the twelfth switch S21 connects the gate of the sixth transistor N101 to the fourth control node PD1, the thirteenth switch S31 isolates the third voltage rail VDD2MH from the gate of the fifth transistor P101, and the fourteenth switch S41 isolates the fourth voltage rail VSS2 from the gate of the sixth transistor N101.

The principle on which the second output buffer 1001 is driven in response to the second control signal SW2 is as follows. For example, in response to the second control signal SW2 having a first level, for example, a high level (H), and the complementary second control signal SW2B having a second level, for example, a low level (L), the fifteenth switch S51 isolates the gate of the seventh transistor P111 from the third control node PU1, the sixteenth switch S61 isolates the gate of the eighth transistor N111 from the fourth control node PD1, the seventeenth switch S71 connects the third voltage rail VDD2MH to the gate of the seventh transistor P111, and the eighteenth switch S81 connects the fourth voltage rail VSS2 to the gate of the eighth transistor N111.

However, in response to the second control signal SW2 having a second level, for example, a low level (L), and the complementary second control signal SW2B having a first level, for example, a high level (H), the fifteenth switch S51 connects the gate of the seventh transistor P111 to the third control node PU1, the sixteenth switch S61 connects the gate of the eighth transistor N111 to the fourth control node PD1, the seventeenth switch S71 isolates the third voltage rail VDD2MH from the gate of the seventh transistor P111, and the eighteenth switch S81 isolates the fourth voltage rail VSS2 from the gate of the eighth transistor N111.

The compensation capacitor unit 1501 includes a third compensation capacitor C11 and a fourth compensation capacitor C21.

The third compensation capacitor C11 is connected between the output node NO1 and the right node N121 of the third cascode current mirror 1211, and the fourth compensation capacitor C21 is connected between the output node NO1 and the right node N221 of the fourth cascode current mirror 1231. However, the second output buffer 1001 may not include the third compensation capacitor C11 and the fourth compensation capacitor C21.

The third output circuit 1401_1 including the fifth transistor P101 and the sixth transistor N101 which have a common source configuration is connected between the third voltage rail VDD2MH and the fourth voltage rail VSS2. Likewise, the fourth output circuit 1401_2 including the seventh transistor P111 and the eighth transistor N111 which have a common source configuration is connected between the third voltage rail VDD2MH and the fourth voltage rail VSS2.

Bias currents of the fifth transistor P101 and the seventh transistor P111 are determined by a third control voltage, that is, a voltage of the third control node PU1, applied to the gates of the fifth transistor P101 and the seventh transistor P111, and bias currents of the sixth transistor N101 and the eighth transistor N111 are determined by a fourth control voltage, that is, a voltage of the fourth control node PU1, applied to the gates of the sixth transistor N101 and the eighth transistor N111.

The short-circuit preventing unit 1701 includes a third short-circuit preventing switch S91 and a fourth short-circuit preventing switch S101.

The third short-circuit preventing switch S91 is connected between the output node NO1 and the third output terminal $V_{outh_2}$ of the third output circuit 1401_1, and connects or disconnects the output node NO1 and the third output terminal $V_{outh_2}$ in response to the first control signal SW1 and the complementary first control signal SW1B.

The fourth short-circuit preventing switch S101 is connected between the output node NO1 and the fourth output terminal $V_{outl_2}$ of the fourth output circuit 1401_2, and connects or disconnects the output node NO1 and the fourth output terminal $V_{outl_2}$ in response to the second control signal SW2 and the complementary second control signal SW2B.

Referring to FIG. 4 again, the first output terminal $V_{outh_1}$ of the first output buffer 100*h* is connected to the third output terminal $V_{outh_2}$ of the second output buffer 1001, and the second output terminal $V_{outl_1}$ of the first output buffer 100*h* is connected to the fourth output terminal $V_{outl_2}$ of the second output buffer 1001.

Accordingly, when a source line driving signal is output to the first output terminal $V_{outh_1}$ of the first output buffer 100*h*, in order to prevent a short-circuit between the first output terminal $V_{outh_1}$ of the first output buffer 100*h* and the third output terminal $V_{outh_2}$ of the second output buffer 1001, the third short-circuit preventing switch S91 disconnects the output node NO1 from the third output terminal $V_{outh_2}$.

Likewise, when a source line driving signal is output to the second output terminal $V_{outl_1}$ of the first output buffer 100*h*, in order to prevent a short-circuit between the second output terminal $V_{outl_1}$ of the first output buffer 100*h* and the fourth output terminal $V_{outl_2}$ of the second output buffer 1001, the fourth short-circuit preventing switch S101 disconnects the output node NO1 from the fourth output terminal $V_{outl_2}$.

Figure 7:
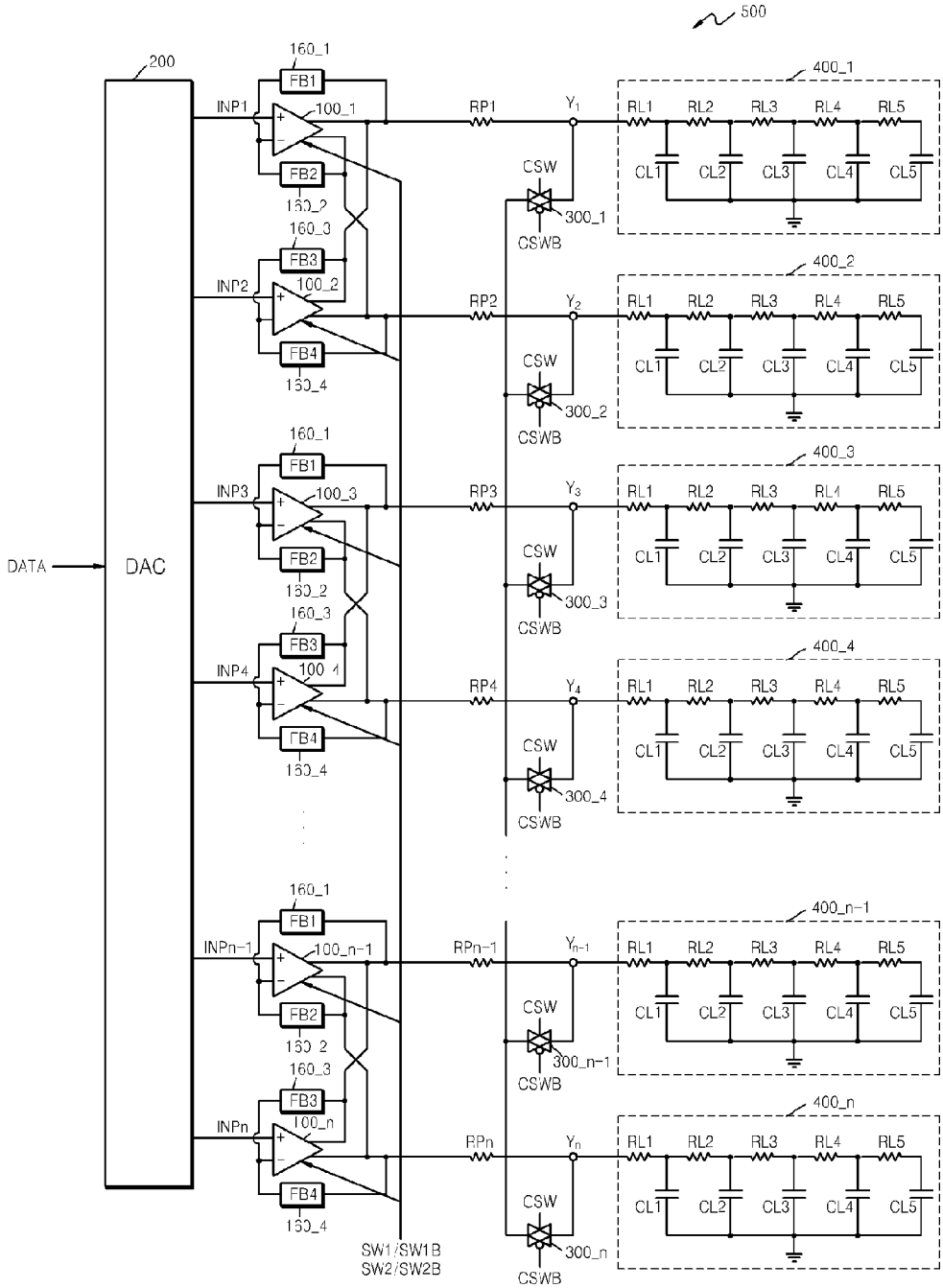
FIG. 7 is a circuit diagram of a display driving device including the source driver including the split rail-to-rail output buffer of FIG. 5, according to an exemplary embodiment of the inventive concept.

FIG. 7 is a circuit diagram of a display driving device 500 including the source driver 52 including the split rail-to-rail output buffer 100 of FIG. 5, according to an embodiment of the inventive concept.

The display driving device 500 may drive a flat panel display device such as a thin-film transistor-liquid crystal display (TFT-LCD) device, a plasma display panel (PDP), or an organic light emitting display (OLED) device.

The display driving device 500 includes a digital-analog converter (DAC) 200, a plurality of output buffers 100_1, 100_2, 100_3, . . . , 100_*n* (n is a natural number), and a plurality of charge sharing switches 300_1, 300_2, 300_3, . . . , 300_*n* (n is a natural number).

Also, the display driving device 500 includes a plurality of output protection resistors RP1, RP2, RP3, RPn (n is a natural number), and a plurality of loads 400_1, 400_2, 400_3, . . . , 400_*n* (n is a natural number) respectively connected to a plurality of source lines Y1, Y2, Y3, . . . , Yn (n is a natural number). The configurations of the plurality of loads 400_1, 400_2, 400_3, . . . , 400_*n* connected to the plurality of source lines Y1, Y2, Y3, . . . , Yn and the plurality of output protection resistors RP1, RP2, RP3, . . . , RPn are the same as those stated with reference to FIGS. 2 and 3, and thus a detailed explanation thereof will not be given.

The DAC 210 converts digital image signals DATA into analog image signals INP1, INP2, INP3, . . . , INPn and outputs the converted analog image signals INP1, INP2, INP3, . . . , INPn. The analog image signals INP1, INP2, INP3, . . . , INPn represent gray level voltages.

The plurality of output buffers 100_1, 100_2, 100_3, . . . 100_*n* respectively amplify the analog image signals INP1, INP2, INP3, . . . INPn, and output the amplified analog image signals as source line driving signals. The source line driving signals are respectively applied to the loads 400_1, 400_2, 400_3, . . . 400_*n* respectively connected to the source lines Y1, Y2, . . . , Yn.

The configuration of each of the plurality of output buffers 100_1, 100_2, 100_3, . . . 100_*n* is substantially the same as that of the split rail-to-rail output buffer 100 of FIG. 4. In detail, each of the plurality of output buffers 100_1, 100_3, . . . 100_*n*−1 corresponds to the first output buffer 100*h* of FIG. 5, and each of the plurality of output buffers 100_2, 100_4, . . . 100_*n* corresponds to the second output buffer 1001 of FIG. 6. Accordingly, each of the output buffers 100_*n*−1 and 100_n may function as a unit gain output buffer of the display driving device 500.

The first control signal SW1 and the complementary first control signal SW1B generated by using the first control signal SW1, and the second control signal SW2 and the complementary second control signal SW2B generated by using the second control signal SW2 are input to each of the plurality of output buffers 100_1, 100_2, 100_3, . . . 100_*n*.

The plurality of charge sharing switches 300_1, 300_2, 300_3, . . . 300_*n* precharge voltages of the source line driving signals to precharge voltages by sharing charges stored in the loads 400_1, 400_2, 400_3, and 400*n* connected to the source lines Y1, Y2, . . . , Yn in response to a sharing switch control signal CSW and a complementary sharing switch control signal CSWB.

The precharge voltage may be VDD2/2 when voltage polarities of adjacent source line driving signals are opposite, for example, when a first source line driving signal has a positive polarity voltage between VDD2 and VDD2ML and a second source line driving signal has a negative polarity voltage between VDD2MH and VSS2. Such a charge sharing method is used in a general source driver for driving a large liquid crystal panel in order to reduce current supply to the plurality of output buffers 100_1, 100_2, 100_3, . . . 100_*n*.

The plurality of charge sharing switches 300_1, 300_2, 300_3, . . . 300_*n* may control all of the source line driving signals to have a predetermined voltage, e.g., VDD2/2, for a charge sharing time before the plurality of output buffers 100_1, 100_2, 100_3, . . . 100_*n* output the source line driving signals. That is, after all of the source line driving signals are precharged to a predetermined voltage, for example, VDD2/2, the source line driving signals amplified by the plurality of output buffers 100_1, 100_2, 100_3, . . . 100_*n* may be applied to the loads 400_1, 400_2, 400_3, . . . 400_*n*, respectively.

In a charge sharing mode, in response to the charge sharing control signal CSW having a first level, for example, a high level (H), and the complementary charge sharing control signal CSWB having a second level, for example, a low level (L), the source lines Y1, Y2, . . . , Yn respectively connected to the plurality of output buffers 100_1, 100_2, 100_3, . . . 100_*n* may be connected to be precharged to a precharge voltage.

In an amplification mode, in response to the charge sharing control signal CSW having a second level, for example, a low level (L), and the complementary charge sharing control signal CSWB having a first level, for example, a high level (H), the source lines Y1, Y2, . . . , Yn respectively connected to the plurality of output buffers 100_1, 100_2, 100_3, . . . 100_*n* may not be connected, and the plurality of output buffers 100_1, 100_2, 100_3, . . . 100_*n* may output the source line driving signals in response to the first control signal SW1 and the second control signal SW2. At this time, after all of the source line driving signals are precharged to a predetermined voltage, for example, VDD2/2, the source line driving signals amplified by the plurality of output buffers 100_1, 100_2, 100_3, . . . 100_*n* may be respectively applied to the loads 400_1, 400_2, 400_3, . . . 400_*n*.

The first control signal SW1 and the second control signal SW2 may correspond to signals obtained by delaying the charging switch control signal CSW for controlling the source lines Y1, Y2, . . . , Yn to be precharged to a precharge voltage.

The first control signal SW1 and the second control signal SW2 may correspond to signals obtained by delaying the sharing switch control signal CSW through D flip-flops by a charge sharing time that is a time taken for the source lines Y1, Y2, . . . , Yn to be precharged to the precharge voltage.

FIG. 8A illustrates a case where a source driver uses dot inversion in one frame. FIG. 8B illustrates a case where a source driver uses line inversion in one frame. FIG. 8C illustrates a case where a source driver uses column inversion in one frame.

In the dot inversion illustrated in FIG. 8A, negative and positive values vary whenever rows and columns vary. In the line inversion illustrated in FIG. 8B, negative and positive values vary whenever rows vary. In the column inversion illustrated in FIG. 8C, negative and positive values vary whenever columns vary.

The dot inversion illustrated in FIG. 8A, the line inversion illustrated in FIG. 8B, and the column inversion illustrated in FIG. 8C may be implemented by using the split rail-to-rail output buffer 100, which will be explained below with reference to FIGS. 9A through 9D.

FIGS. 9A through 9D illustrate output voltages of the split rail-to-rail output buffer 100 of FIG. 4 in a first mode, a second mode, a third mode, and a fourth mode, respectively.

FIG. 9A illustrates an output voltage of the split rail-to-rail output buffer 100 of FIG. 4 in the first mode, for example, when the first control signal has a high level and the second control signal has a high level. Since driving voltages VDD2 and VDD2ML of the first output buffer 100*h* are higher than driving voltages VDD2MH and VSS2 of the second output buffer 1001 in FIG. 4, an output voltage of the first output buffer 100*h* may be a positive (+) voltage, and an output voltage of the second output buffer 1001 may be a negative (−) voltage.

Referring to FIGS. 4, 5, and 6, in the first mode, for example, when the first control signal has a high level and the second control signal has a high level, a positive (+) voltage is output to the first output terminal $V_{outh_1}$ and the second output terminal $V_{outl_1}$ of the first output buffer 100*h*.

In this case, the third short-circuit preventing switch S91 of the second output buffer 1001 disconnects the output node NO1 from the third output terminal $V_{outh_2}$, and the fourth short-circuit preventing switch S101 disconnects the output node NO1 from the fourth output terminal $V_{outl_2}$.

The first feedback circuit 160_1 connects the first output terminal $V_{outh_1}$ of the first output buffer 100*h* to the negative input terminal of the first output buffer 100*h* to form a negative feedback circuit of the first output buffer 100*h*, and the second feedback circuit 160_2 connects the second output terminal $V_{outl_1}$ of the first output buffer 100*h* to the negative input terminal of the first output buffer 100*h* to form a negative feedback circuit of the first output buffer 100*h*.

FIG. 9B illustrates an output voltage of the split rail-to-rail output buffer 100 of FIG. 4 in the second mode, for example, when the first control signal has a low level and the second control signal has a low level.

Referring to FIGS. 4, 5, and 6, in the second mode, for example, when the first control signal has a low level and the second control signal has a low level, a negative (−) voltage is output to the third output terminal $V_{outh_2}$ and the fourth output terminal $V_{outl_2}$ of the second output buffer 1001.

In this case, the first short-circuit preventing switch S9*h* of the first output buffer 100*h* disconnects the output node NOh from the first output terminal $V_{outh_1}$, and the second short-circuit preventing switch 510*h* disconnects the output node NOh from the second output terminal $V_{outl_1}$.

The third feedback circuit 160_3 connects the third output terminal $V_{outh_2}$ of the second output buffer 1001 to the negative input terminal of the second output buffer 1001 to form a negative feedback circuit of the second output buffer 1001, and the fourth feedback circuit 160_4 connects the fourth output terminal $V_{outl_2}$ of the second output buffer 1001 to the negative input terminal of the second output buffer 1001 to form a negative feedback circuit of the second output buffer 1001.

FIG. 9C illustrates an output voltage of the split rail-to-rail output buffer 100 of FIG. 4 in the third mode, for example, when the first control signal has a high level and the second control signal has a low level.

Referring to FIGS. 4, 5, and 6, in the third mode, for example, when the first control signal has a high level and the second control signal has a low level, a positive (+) voltage is output to the first output terminal $V_{outh_1}$ of the first output buffer 100*h*, and a negative (−) voltage is output to the fourth output terminal $V_{outl_2}$ of the second output buffer 1001.

In this case, the second short-circuit preventing switch S10*h* of the first output buffer 100*h* disconnects the output node NOh from the second output terminal $V_{outl_1}$, and the third short-circuit preventing switch S91 of the second output buffer 1001 disconnects the output node NO1 from the third output terminal $V_{outh_2}$.

The first feedback circuit 160_1 connects the first output terminal $V_{outh_1}$ of the first output buffer 100*h* to the negative input terminal of the first output buffer 100*h* to form a negative feedback circuit of the first output buffer 100*h*, and the fourth feedback circuit 160_4 connects the fourth output terminal $V_{outl_2}$ of the second output buffer 1001 to the negative input terminal of the second output buffer 1001 to form a negative feedback circuit of the second output buffer 1001.

FIG. 9D illustrates an output voltage of the split rail-to-rail output buffer 100 of FIG. 4 in the fourth mode, for example, when the first control signal has a low level and the second control signal has a high level.

Referring to FIGS. 4, 5, and 6, in the fourth mode, for example, when the first control signal has a low level and the second control signal has a high level, a positive (+) voltage is output to the second output terminal $V_{outl_1}$ of the first output buffer 100*h*, and a negative (−) voltage is output to the third output terminal $V_{outh_2}$ of the second output buffer 1001.

In this case, the first short-circuit preventing switch S9*h* of the first output buffer 100*h* disconnects the output node NOh from the first output terminal $V_{outl_1}$, and the fourth short-circuit preventing switch 5101 of the second output buffer 1001 disconnects the output node NO1 from the fourth output terminal $V_{outl_}$2.

The second feedback circuit 160_2 connects the second output terminal $V_{outl_1}$ of the first output buffer 100*h* to the negative input terminal of the first output buffer 100*h* to form a negative feedback circuit of the first output buffer 100*h*, and the third feedback circuit 160_3 connects the third output terminal $V_{outl_2}$ of the second output buffer 1001 to the negative input terminal of the second output buffer 1001 to form a negative feedback circuit of the second output buffer 1001.

Accordingly, the line inversion of FIG. 8B may be implemented in the first mode and the second mode, the column inversion of FIG. 8C may be implemented in the third mode, and the dot inversion may be implemented in the third mode and the fourth mode.

Figure 10A:
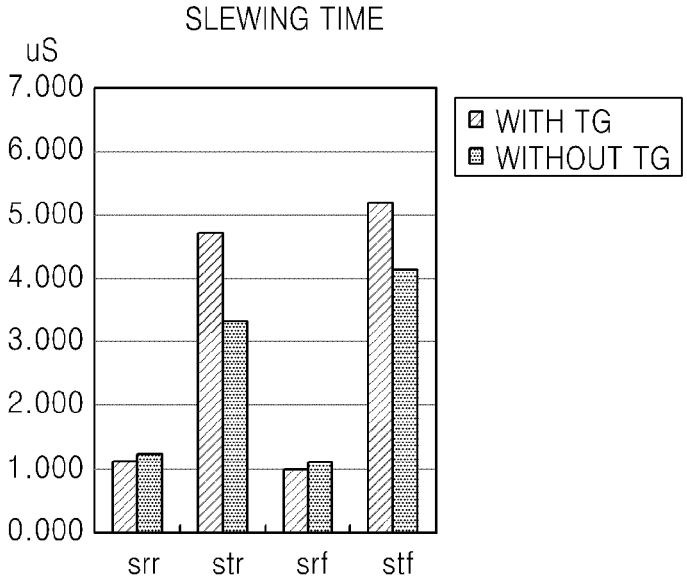
FIGS. 10A and 10B are graphs illustrating slewing times of a conventional split rail-to-rail output buffer and a split rail-to-rail output buffer according to the inventive concept in column inversion.
Figure 10B:
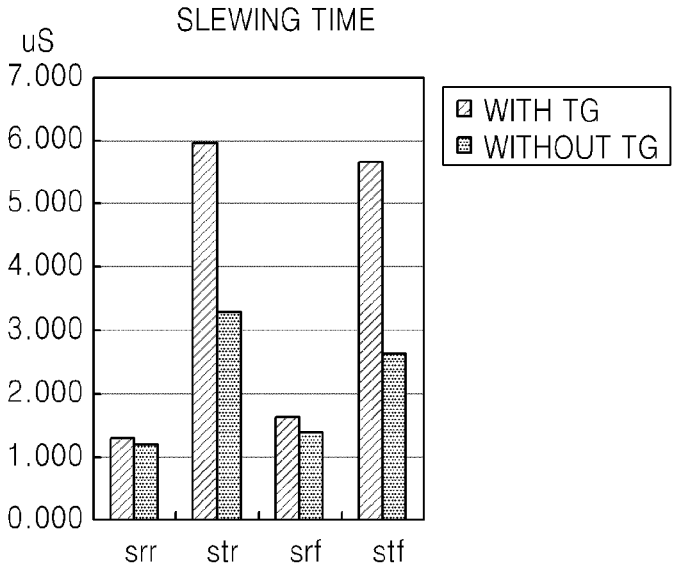
Figure 10C:
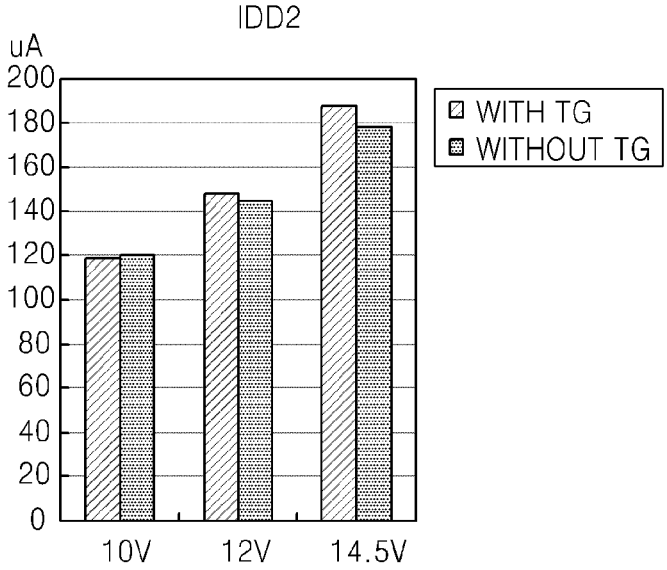
FIG. 10C is a graph illustrating currents flowing through the conventional split rail-to-rail output buffer and the split rail-to-rail output buffer according to the inventive concept.

FIGS. 10A and 10B are graphs illustrating slewing times of a conventional split rail-to-rail output buffer and a split rail-to-rail output buffer according to the inventive concept in column inversion. FIG. 10C is a graph illustrating currents flowing through the conventional split rail-to-rail output buffer and the split rail-to-rail output buffer according to the inventive concept.

FIGS. 10A and 10B illustrate slewing times and settling times of the conventional split rail-to-rail output buffer with an output transmission gate and the split rail-to-rail output buffer 100 without an output transmission gate when VDD2 is 10 V and a load RD has a resistance RL of 15 KΩ and a capacitance CL of 250 ρF. FIG. 10A illustrates the first output buffer 100*h* of FIG. 4, FIG. 10B illustrates the second output buffer 1001 of FIG. 4, and FIG. 10C illustrates a current IDD2 flowing through the first output buffer 100*h* and the second output buffer 1001.

A slewing time is defined as a time taken to reach 90% of a target voltage and a settling time is defined as a time taken to reach 95% of the target voltage. A slewing time srr and a settling time str in a rising mode and a slewing time srf and a settling time stf in a falling mode were compared.

It is found that the split rail-to-rail output buffer 100 without a transmission gate may reduce a slewing time and a settling time without increasing the current IDD2. The split rail-to-rail output buffer 100 may even reduce the current IDD2 and thus reduce power consumption as the voltage VDD2 is increased from 10 V to 14.5 V. Accordingly, when the same power is consumed, the split rail-to-rail output buffer 100 may reduce a slewing time and a settling time greatly, compared to the conventional split rail-to-rail output buffer.

Figure 11A:
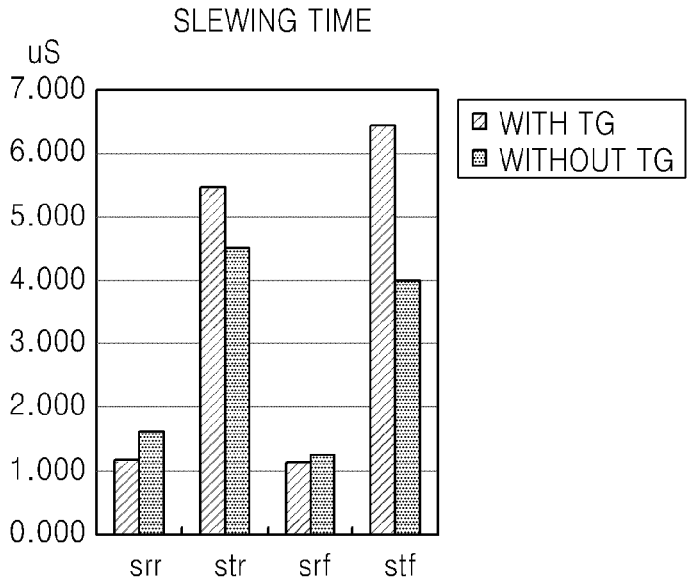
FIG. 11A is a graph illustrating slewing times of a conventional split rail-to-rail output buffer and a split rail-to-rail output buffer according to the inventive concept in dot inversion.
Figure 11B:
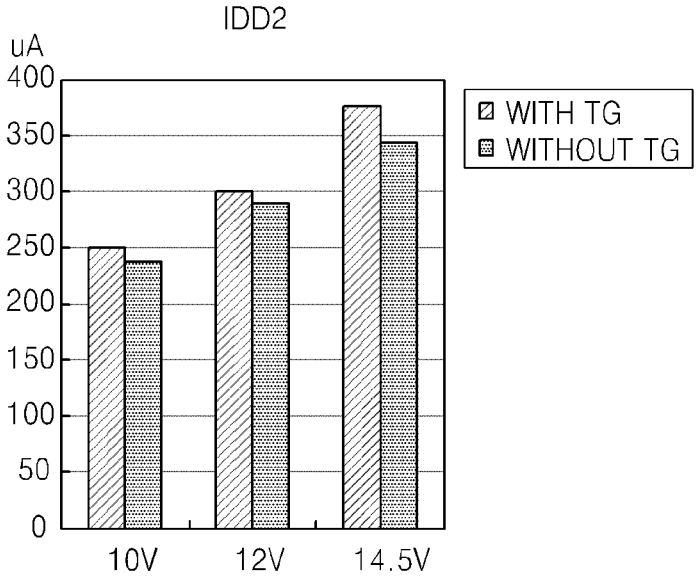
FIG. 11B is a graph illustrating currents flowing through the conventional rail-to-rail output buffer and the split rail-to-rail output buffer according to the inventive concept.

FIG. 11A is a graph illustrating slewing times of a conventional split rail-to-rail output buffer and a split rail-to-rail output buffer according to the inventive concept in dot inversion. FIG. 11B is a graph illustrating currents flowing through the conventional rail-to-rail output buffer and the split rail-to-rail output buffer according to the inventive concept.

It is found from FIGS. 11A and 11B that the split rail-to-rail output buffer 100 without a transmission gate may reduce a slewing time and a settling time without increasing the current IDD2. The slewing time of the split rail-to-rail output buffer 100 is almost the same or slightly longer than that of the conventional split rail-to-rail output buffer, whereas the settling time of the split rail-to-rail output buffer 100 is much shorter than that of the conventional split rail-to-rail output buffer.

As described above, the split rail-to-rail output buffer according to the inventive concept may obtain a high slew rate, a fast slewing time, and a fast settling time while maintaining or reducing power consumption. Also, since the split rail-to-rail output buffer according to the inventive concept does not include a transmission gate, the size of a chip may be reduced and heat may be prevented from being generated in the transmission gate.

While not restricted thereto, exemplary embodiments, including the methods thereof, can also be embodied as computer-readable code on a computer-readable recording medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network-coupled computer systems so that the computer-readable code is stored and executed in a distributed fashion. Also, exemplary embodiments may be written as computer programs transmitted over a computer-readable transmission medium, such as a carrier wave, and received and implemented in general-use or special-purpose digital computers that execute the programs.

While the inventive concept has been particularly shown and described with reference to exemplary embodiments thereof using specific terms, the embodiments and terms have been used to explain the inventive concept and should not be construed as limiting the scope of the inventive concept defined by the claims. The exemplary embodiments should be considered in a descriptive sense only and not for purposes of limitation. Therefore, the scope of the inventive concept is defined not by the detailed description of the inventive concept but by the appended claims, and all differences within the scope will be construed as being included in the inventive concept.

What is claimed is:

1. An output buffer, which is included in a source driver of a display driving device and outputs a source line driving signal for driving a source line, the output buffer comprising:

a first output buffer driven between a first voltage rail and a second voltage rail, and adapted to output a first source line driving signal to a first output terminal in response to a first control signal and output a second source driving signal to a second output terminal in response to a second control signal;

a second output buffer driven between a third voltage rail and a fourth voltage rail, and adapted to output a third source line driving signal to a third output terminal in response to the first control signal and output a fourth source line driving signal to a fourth output terminal in response to the second control signal; and a feedback circuit for connecting the first through fourth output terminals to negative input terminals of the first and second output buffers in response to the first control signal and the second control signal, wherein the first output terminal of the first output buffer is connected to the third output terminal of the second output buffer, and the second output terminal of the first output buffer is connected to the fourth output terminal of the second output buffer.

2. The output buffer of claim 1, wherein the feedback circuit comprises:

a first feedback circuit for connecting the first output terminal of the first output buffer to the negative input terminal of the first output buffer in response to the first control signal;

a third feedback circuit for connecting the third output terminal of the second output buffer to the negative input terminal of the second output buffer in response to the first control signal;

a second feedback circuit for connecting the second output terminal of the first output buffer to the negative input terminal of the first output buffer in response to the second control signal; and a fourth feedback circuit for connecting the fourth output terminal of the second output buffer to the negative input terminal of the second output buffer in response to the second control signal.

3. The output buffer of claim 1, wherein the first output buffer comprises:

a first input circuit for generating first differential currents and second differential currents in response to a voltage difference between first differential input signals;

a first output buffer output circuit comprising a first output circuit comprising a first transistor connected between the first voltage rail and the first output terminal and a second transistor connected between the first output terminal and the second voltage rail, and a second output circuit comprising a third transistor connected between the first voltage rail and the second output terminal and a fourth transistor connected between the second output terminal and the second voltage rail;

a first current summing circuit comprising a first control node for outputting a first control voltage for controlling a current flowing through at least one of the first transistor and the third transistor in response to the first differential currents, and a second control node for outputting a second control voltage for controlling a current flowing through at least one of the second transistor and the fourth transistor in response to the second differential currents; and a first output buffer switch circuit comprising a first switch circuit for connecting a gate of the first transistor to any one of the first control node and the first voltage rail and connecting a gate of the second transistor to any one of the second control node and the second voltage rail in response to the first control signal, and a second switch circuit for connecting a gate of the third transistor to any one of the first control node and the first voltage rail and connecting a gate of the fourth transistor to any one of the second control node and the second voltage rail in response to the second control signal.

4. The output buffer of claim 3, wherein the current summing circuit comprises:

a first cascode current mirror connected between the first voltage rail and the first control node; and a second cascode current mirror connected between the second voltage rail and the second control node.

5. The output buffer of claim 3, further comprising:

a first compensation capacitor connected between an output node of the first output buffer and a first node of the first cascode current mirror to which any one of the first differential currents is supplied; and a second compensation capacitor connected between the output node of the first output buffer and a second node of the second cascode current mirror to which any one of the second differential currents is supplied.

6. The output buffer of claim 3, further comprising a short-circuit preventing unit comprising:

a first short-circuit preventing switch connected between the output node of the first output buffer and the first output terminal of the first output circuit, and adapted to connect or disconnect the output node and the first output terminal in response to the first control signal; and a second short-circuit preventing switch connected between the output node of the first output buffer and the second output terminal of the second output circuit, and adapted to connect or disconnect the output node and the second output terminal in response to the second control signal.

7. The output buffer of claim 3, wherein the first switch circuit connects the gate of the first transistor to the first control node and connects the gate of the second transistor to the second control node in response to the first control signal, connects the gate of the first transistor to the first voltage rail and connects the gate of the second transistor to the second voltage rail in response to the first control signal, and the second switch circuit connects the gate of the third transistor to the first control node, connects the gate of the fourth transistor to the second control node in response to the second control signal, and connects the gate of the third transistor to the first voltage rail and connects the gate of the fourth transistor to the second voltage rail in response to the second control signal.

8. The output buffer of claim 3, wherein the first switch circuit comprises:

a first switch for controlling connection between the first control node and the gate of the first transistor in response to the first control signal;

a second switch for controlling connection between the second control node and the gate of the second transistor in response to the first control signal;

a third switch for controlling connection between the first voltage rail and the gate of the first transistor in response to the first control signal; and a fourth switch for controlling connection between the second voltage rail and the gate of the second transistor in response to the first control signal, and the second switch circuit comprises:

a fifth switch for controlling connection between the first control node and the gate of the third transistor in response to the second control signal;

a sixth switch for controlling connection between the second control node and the gate of the fourth transistor in response to the second control signal;

a seventh switch for controlling connection between the first voltage rail and the gate of the third transistor in response to the second control signal; and an eighth switch for controlling connection between the second voltage rail and the gate of the fourth transistor in response to the second control signal.

9. The output buffer of claim 8, wherein each of the first switch, the second switch, the fifth switch, and the sixth switch comprises a transmission gate.

10. The output buffer of claim 3, further comprising a bias circuit connected between the first control node and the second control node, and adapted to determine a static current of each of the first transistor, the second transistor, the third transistor, and the fourth transistor.

11. The output buffer of claim 3, wherein the second output buffer comprises:

a second input circuit for generating third differential currents and fourth differential currents in response to a voltage difference between second differential input signals;

a second output buffer output circuit comprising a third output circuit comprising a fifth transistor connected between the third voltage rail and the third output terminal and a sixth transistor connected between the third output terminal and the fourth voltage rail, and a fourth output circuit comprising a seventh transistor connected between the third voltage rail and the fourth output terminal and an eighth transistor connected between the fourth output terminal and the fourth voltage rail;

a second current summing circuit comprising a third control node for outputting a third control voltage for controlling a current flowing through at least one of the fifth transistor and the seventh transistor in response to the third differential currents, and a fourth control node for outputting a fourth control voltage for controlling a current flowing through the sixth transistor and/or the eighth transistor in response to the fourth differential currents; and a second output buffer switch circuit comprising a third switch circuit for connecting a gate of the fifth transistor to any one of the third control node and the third voltage rail and connecting a gate of the sixth transistor to any one of the fourth control node and the fourth voltage rail in response to the first control signal, and a fourth switch circuit for connecting a gate of the seventh transistor to any one of the third control node and the third voltage rail and connecting a gate of the eighth transistor to any one of the fourth control node and the fourth voltage rail in response to the second control signal.

12. The output buffer of claim 11, further comprising:

a first short-circuit preventing switch connected between an output node of the second output buffer and the third output terminal of the third output circuit, and adapted to connect or disconnect the output node and the third output terminal in response to the first control signal; and a second short-circuit preventing switch connected between the output node of the second output buffer and the fourth output terminal, and adapted to connect or disconnect the output node and the fourth output terminal in response to the second control signal.

13. The output buffer of claim 11, wherein the first switch circuit comprises:

a first switch for controlling connection between the first control node and the gate of the first transistor in response to the first control signal;

a second switch for controlling connection between the second control node and the gate of the second transistor in response to the first control signal;

a third switch for controlling connection between the first voltage rail and the gate of the first transistor in response to the first control signal; and a fourth switch for controlling connection between the second voltage rail and the gate of the second transistor in response to the first control signal, wherein the third switch connects the gate of the fifth transistor to the third control node, connects the gate of the sixth transistor to the fourth control node in response to the first control signal, and connects the gate of the fifth transistor to the third voltage rail and connects the gate of the sixth transistor to the fourth voltage rail in response to the first control signal, and the fourth switch circuit connects the gate of the seventh transistor to the third control node, connects the gate of the eighth transistor to the fourth control node in response to the second control signal, and connects the gate of the seventh transistor to the third voltage rail and connects the gate of the eighth transistor to the fourth voltage rail in response to the second control signal.

14. The output buffer of claim 11, wherein the third switch circuit comprises:

a ninth switch for controlling connection between the third control node and the gate of the fifth transistor in response to the first control signal;

a tenth switch for controlling connection between the fourth control node and the gate of the sixth transistor in response to the first control signal;

an eleventh switch for controlling connection between the third voltage rail and the gate of the fifth transistor in response to the first control signal; and a twelfth switch for controlling connection between the fourth voltage rail and the gate of the sixth transistor in response to the first control signal, and the fourth switch circuit comprises:

a thirteenth switch for controlling connection between the third control node and the gate of the seventh transistor in response to the second control signal;

a fourteenth switch for controlling connection between the fourth control node and the gate of the eighth transistor in response to the second control signal;

a fifteenth switch for controlling connection between the third voltage rail and the gate of the seventh transistor in response to the second control signal; and a sixteenth switch for controlling connection between the fourth voltage rail and the gate of the eighth transistor in response to the second control signal.

15. The output buffer of claim 14, wherein each of the ninth switch, the tenth switch, the thirteenth switch, and the fourteenth switch comprises a transmission gate.

16. A method of controlling an output buffer that is included in a source driver of a display driving device and outputs a source line driving signal for driving a source line, the method comprising:

driving a first output buffer between a first voltage rail and a second voltage rail, outputting a source line driving signal to a first output terminal in response to a first control signal and outputting a source line driving signal to a second output terminal in response to a second control signal;

driving a second output buffer between a third voltage rail and a fourth voltage rail, outputting a source line driving signal to a third output terminal in response to the first control signal and outputting a source line driving signal to a fourth output terminal in response to the second control signal; and connecting the first through fourth output terminals to negative input terminals in response to the first control signal and the second control signal, wherein the first output terminal is connected to the third output terminal, and the second output terminal is connected to the fourth output terminal.

17. A display driving device comprising:

a plurality of unit gain output buffers; and a plurality of charge sharing switches for controlling connections of the plurality of unit gain output buffers respectively connected to source lines in response to charge sharing control signals, wherein each of the plurality of unit gain output buffers comprises:

a first output buffer driven between a first voltage rail and a second voltage rail, and adapted to output a source line driving signal to a first output terminal in response to a first control signal and output a source line driving signal to a second output terminal in response to a second control signal;

a second output buffer driven between a third voltage rail and a fourth voltage rail, and adapted to output a source line driving signal to a third output terminal in response to the first control signal and output a source line driving signal to a fourth output terminal in response to the second control signal; and a feedback circuit for connecting the first through fourth output terminals to negative input terminals of the first and second output buffers in response to the first control signal and the second control signal, wherein the first output terminal of the first output buffer is connected to the third output terminal of the second output buffer, and the second output terminal of the first output buffer is connected to the fourth output terminal of the second output buffer.

18. The display driving device of claim 17, wherein, in a charge sharing mode, the source lines are respectively connected to the plurality of unit gain output buffers, so that the source lines are precharged to a precharge voltage, and in an amplification mode, the source lines are not connected to the plurality of unit gain output buffers, so that the plurality of unit gain output buffers output source line driving signals in response to the first control signal and the second control signal.

19. The display driving device of claim 18, wherein each of the first control signal and the second control signal corresponds to a signal obtained by delaying a sharing switch control signal for controlling the source lines to be precharged to the precharge voltage.

20. The display driving device of claim 18, wherein each of the first control signal and the second control signal corresponds to a signal obtained by delaying the sharing switch control signal through D flip-flops by a charge sharing time that is a time taken for the source lines to be precharged to the precharge voltage.

* * * * *